US007761032B2

(12) United States Patent
Murayama

(10) Patent No.: US 7,761,032 B2
(45) Date of Patent: Jul. 20, 2010

(54) DRUM UNIT WITH PHOTOSENSITIVE DRUMS FOR ATTACHMENT WITH AN IMAGE FORMING APPARATUS MAIN BODY

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 848 days.

(21) Appl. No.: 11/524,451

(22) Filed: Sep. 21, 2006

(65) Prior Publication Data

US 2007/0071497 A1 Mar. 29, 2007

(30) Foreign Application Priority Data

Sep. 29, 2005 (JP) ..... 2005-283781

(51) Int. Cl.
*G03G 21/18* (2006.01)

(52) U.S. Cl. ..... 399/112

(58) Field of Classification Search ..... 399/107, 399/111, 112, 116, 117, 159, 167
See application file for complete search history.

(56) References Cited

U.S. PATENT DOCUMENTS 4,621,919 A * 11/1986 Nitanda et al. ..... 399/117
5,512,976 A * 4/1996 Kamano ..... 399/116
5,745,825 A * 4/1998 Okawa et al. ..... 399/117
5,878,310 A * 3/1999 Noda et al. ..... 399/117
5,926,673 A * 7/1999 Foster et al. ..... 399/167
7,254,347 B2 * 8/2007 Matsumoto et al. ..... 399/13
2006/0140676 A1 6/2006 Kamimura
2006/0153590 A1 7/2006 Igarashi

FOREIGN PATENT DOCUMENTS

JP 9-179372 7/1997
JP 11-258966 9/1999
JP 11315891 A * 11/1999
JP 2002-182450 6/2002
JP 2003-043780 2/2003

* cited by examiner

*Primary Examiner*—Robert Beatty
(74) *Attorney, Agent, or Firm*—Banner & Witcoff, Ltd.

(57) ABSTRACT

An image forming apparatus of a tandem system includes a main body and a drum unit attachable to and detachable from the main body. The drum unit includes photosensitive drums, a housing for rotatably supporting the photosensitive drums, and for each photosensitive drum, a drum gear arranged at an end of the photosensitive drum for transmitting a drive force to the photosensitive drum, and a rotating member having a protrusion rotating with the drum gear, the protrusion being arranged at a position away from a center axis of the rotation of the photosensitive drum. Also, the image forming apparatus includes a transfer unit for transferring developer color images from respective photosensitive drums onto a medium and a guide arranged in the main body for contacting each protrusion and guiding each rotating member during attachment of the drum unit to cause each drum gear to move to a respective predetermined position.

17 Claims, 24 Drawing Sheets

DRUM UNIT WITH PHOTOSENSITIVE DRUMS FOR ATTACHMENT WITH AN IMAGE FORMING APPARATUS MAIN BODY

CROSS REFERENCE TO RELATED APPLICATION

This application claims priority from Japanese Patent Application No. 2005-283781 filed Sep. 29, 2005, the entire contents of which are incorporated herein by reference.

FIELD

Aspects of the present invention relate to an image forming apparatus and, more specifically, to an image forming apparatus of a tandem system.

BACKGROUND

An image forming apparatus of a tandem system in which photosensitive drums corresponding to respective colors are arranged in a direction orthogonal to a rotating shaft and developer (e.g. toner) images formed on surfaces of the respective photosensitive drums are serially transferred to and overlaid on a recording medium or an intermediate transfer member is known in the art. Since drum gears are fixed to ends of the respective photosensitive drums for driving the respective photosensitive drums and the drum gears are generally formed of resin, they may easily shift, which is undesirable, due to a manufacturing error in dimension. For example, when the drum gear has been shifted to an off-centered position, uneven rotation of the photosensitive drum results and fluctuations in rotational speed of the respective photosensitive drums can cause a color drift in the overlaid developer images.

As a consequence, in order to suppress the color drift based on uneven rotation occurring on the photosensitive drums, gears formed by an identical molding die are fixed to the ends of the respective photosensitive drums as described in JP-A-9-179372, and the respective drum gears are provided with marks so that the rotational speeds of the respective photosensitive drums match when the developer images are transferred to the identical position on the recording medium or the intermediate transfer member.

Photosensitive drums are detachably attached to a main body of the image forming apparatus to allow them to be replaced when they deteriorate or wear out over time.

However, in such a configuration in which the photosensitive drums can be attached to and detached from the main body, even though the drum gear is aligned with a predetermined rotational position during manufacturing, there is a risk that the relative rotational position of the drum gears can be displaced when a user moves the gears when handling a paper jam or the like. Therefore, the rotational speeds of the respective photosensitive drums may vary at the time of transfer, which can cause color drift to occur in the formed images.

SUMMARY

According to illustrative aspects of the invention an image forming apparatus of a tandem system includes a main body and a drum unit attachable to and detachable from the main body. The drum unit may include photosensitive drums, a housing for rotatably supporting the photosensitive drums, and for each photosensitive drum, a drum gear arranged at an end of the photosensitive drum for transmitting a drive force to the photosensitive drum, and a rotating member having a protrusion rotating with the drum gear, the protrusion being arranged at a position away from a center axis of the rotation of the photosensitive drum. Also, the image forming apparatus includes a transfer unit for transferring developer color images from respective photosensitive drums onto a medium and a guide arranged in the main body for contacting each protrusion and guiding each rotating member during attachment of the drum unit to cause each drum gear to move to a respective predetermined position.

In other illustrative aspects of the invention, a drum unit attachable to and detachable from a main body of an image forming apparatus is provided which includes photosensitive drums, a housing for rotatably supporting the photosensitive drums, for each photosensitive drum, a drum gear arranged at an end of the photosensitive drum for transmitting a drive force to the photosensitive drum, and a rotating member having a protrusion rotating with the drum gear, the protrusion being arranged at a position away from a center axis of rotation of the photosensitive drum, the rotating member configured to contact a member in the main body of the image forming apparatus.

DETAILED DESCRIPTION

Figure 1:
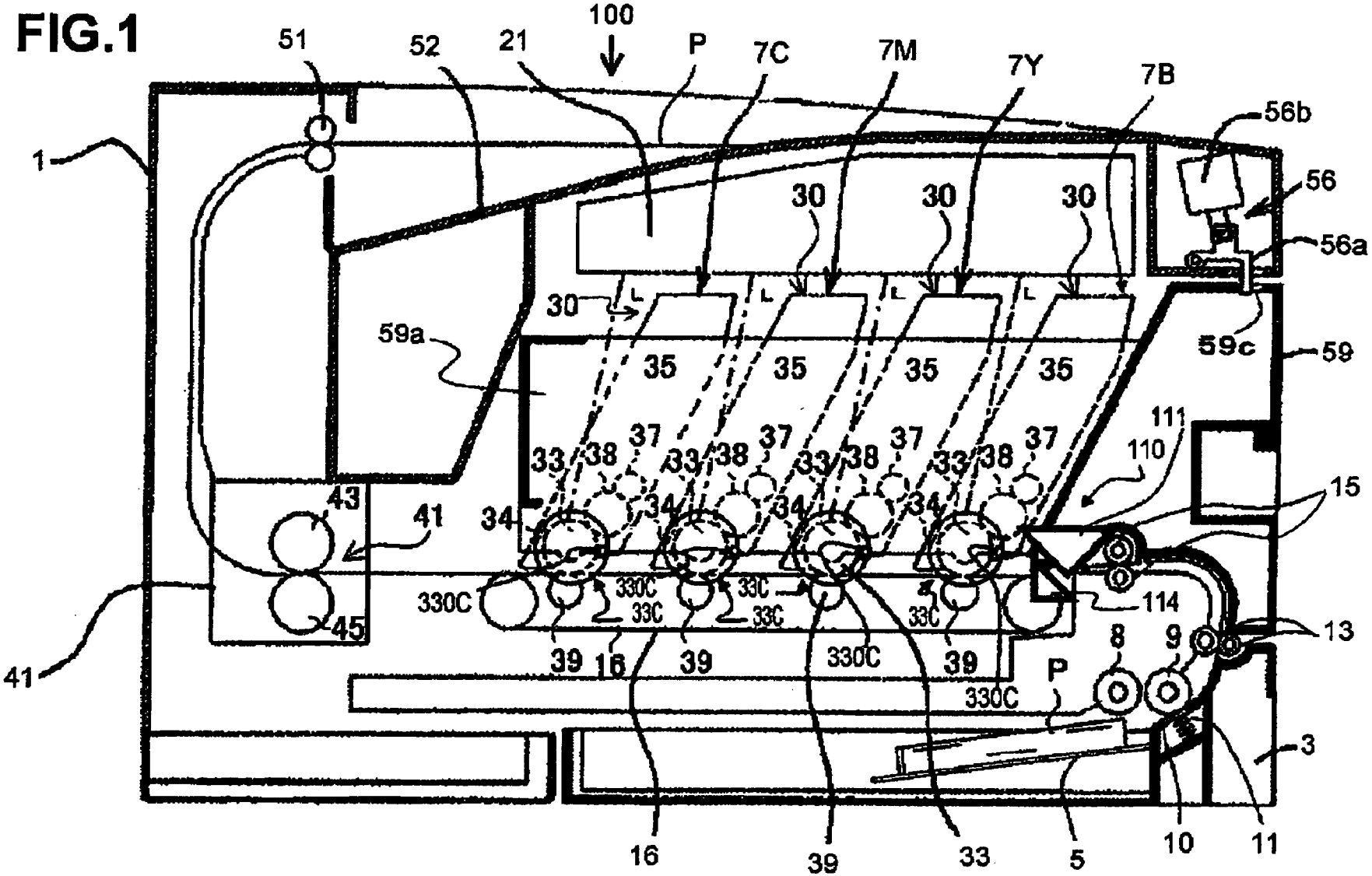
FIG. 1 is a cross-sectional view of a printer according to an illustrative example of the invention 1.

Referring now to the drawings, aspects of the invention will be described.

EXAMPLE 1

General Configuration

FIG. 1 is a cross-sectional view of a printer 100 according to illustrative aspects of the invention. While the image formation device is a printer 100 in this illustrated example, those skilled in the art will understand that features and aspects of the present invention may be applied to and/or practiced in other types of devices, such as facsimile machines, copying machines, other types of printers, multifunction machines, and the like.

In this example, the vertical direction in FIG. 1 is assumed to be the vertical direction, the direction toward the front side of the printer 100 in FIG. 1 is assumed to be a rightward direction, and the direction toward the rear side of the printer 100 in FIG. 1 is assumed to be a leftward direction.

As shown in FIG. 1 a color laser printer 100 includes a paper-feed cassette 3 which can be detachably inserted to a lower portion of a body frame 1. In other words, the paper-feed cassette 3 is detachable toward the front from a storage position shown by a solid line in FIG. 1, and recording papers P can be refilled in a state in which the paper-feed cassette 3 is detached.

A supporting plate 5, which is urged upward by a spring (not shown) is provided in the interior of the paper-feed cassette 3. A pair of paper-feed rollers 8 and 9 is disposed above the supporting plate 5. A pair of paper-feed rollers 8 and 9 separate the recording papers P stacked on the supporting plate 5 and feed them toward process units 7M, 7Y, 7C and 7B. The paper-feed roller 8 on the left side in FIG. 1 is a roller used for carrying the uppermost sheet of recording paper P toward the paper-feed roller 9. The paper-feed roller 9 on the right side in FIG. 1 separates the recording papers P into sheets and carries them in cooperation with a separating pad 10.

The respective rollers including the paper-feed rollers 8 and 9 are rotatably provided at predetermined positions in the body frame 1, and are driven by a drive source common to the process units 7M, 7Y, 7C and 7B. On the other hand, the separating pad 10 is provided in the paper-feed cassette 3 via a spring 11, and is brought into pressing contact with the paper-feed roller 9 by an urging force of the spring 11 when the paper-feed cassette 3 is inserted in a predetermined position.

The process units 7M, 7Y, 7C and 7B for forming images corresponding to respective colors magenta, yellow, cyan and black are disposed slightly above a center of the body frame 1. Along a carrier path for the recording paper P from the paper-feed roller 9 to the process units 7M, 7Y, 7C and 7B, a pair of carrier rollers 13 for carrying the recording paper P and resist rollers 15 for reducing skewed movement of the recording paper P.

A belt 16 for carrying the recording paper P passing through the resist rollers 15 is arranged on a lower side of the four process units 7M, 7Y, 7C and 7B so as to oppose them. Developer images of the respective colors described above are formed on the recording paper P in the respective process units 7M, 7Y, 7C and 7B while the paper P is carried by the belt 16.

A scanner unit 21 includes a polygon mirror (not shown) for reflecting a laser beam L generated by the laser diode (not shown) a reflecting mirror (not shown) for reflecting the laser beam L reflected by the polygon mirror toward a photosensitive drum 33 of each of the process units 7C, 7M, 7Y, 7K, and a fθ lens (not shown) provided in an optical path of the laser beam L.

Each of the process units 7C, 7M, 7Y, 7K is provided with the photosensitive drum 33 having a photosensitive layer on a surface thereof, and also a scorotron charger 34 for causing a surface of the photosensitive drum 33 to be charged uniformly. A toner container 35 is provided above the photosensitive drum 33, so that toner is supplied to the surface of the photosensitive drum 33 by a supply roller 37 and a developing roller 38 provided below the toner container 35.

A developing cartridge 30 includes the toner container 35, the supply roller 37 and the developing roller 38. Each of the process units 7C, 7M, 7Y, 7K is adapted so that a developing cartridge 30 can be separated from the photosensitive drum 33.

The process units 7C, 7M, 7Y, 7K are stored behind a front panel 59, which serves as a side cover provided on a front side of the body frame 1, and in a process unit casing 59*a* coupled to the front panel 59. Specifically, each photosensitive drum 33 is rotatably supported by a housing of the process casing 59*a*, and each developing cartridge 30 is detachably stored in the process casing 59*a*. The photosensitive drums 33 and the process casing 59*a* (e.g., housing) form at least part of a drum unit.

Figure 2:
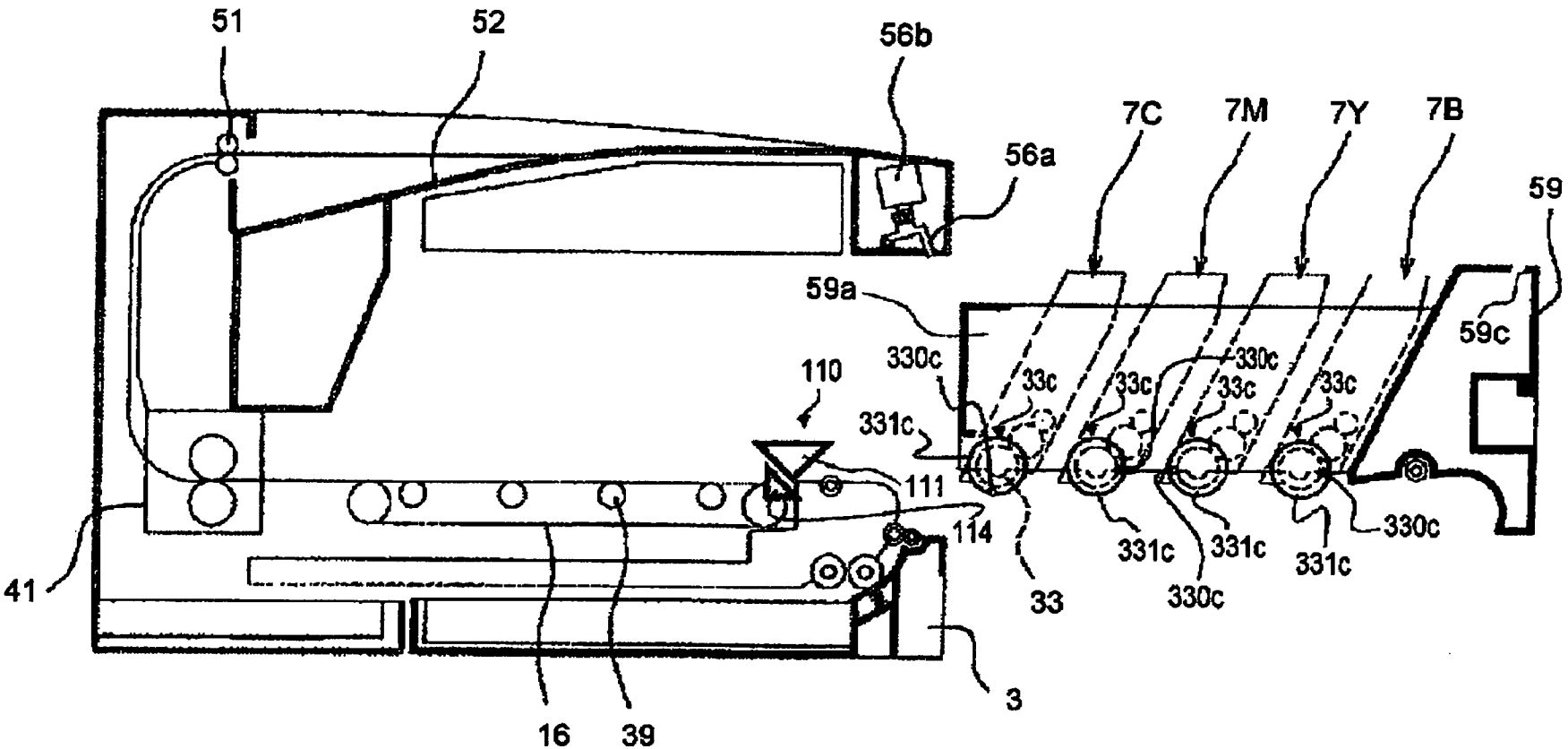
FIG. 2 is a cross-sectional view of the printer in a state in which a process casing is detached from the main body of the printer according to an illustrative aspect of the invention.

FIG. 2 is a cross-sectional view of the printer 100 in a state in which the process casing 59*a* is detached from the printer body.

The process unit casing 59*a* is detached toward the front in a state in which the process units 7C, 7M, 7Y, 7K are stored as shown in FIG. 2.

In this configuration, an electrostatic latent image created by the laser beam L from a scanner unit 21 is formed on the surface of each of the photosensitive drums 33 in a state in which the process casing 59*a* is attached to the body frame 1, and then, the electrostatic latent image is developed by the toner being supplied by the respective developing roller 38 to the surface of the corresponding photosensitive drum 33. Each photosensitive drum 33 opposes a transfer roller 39 with the belt 16 disposed therebetween. Therefore, the developer image obtained by developing the electrostatic latent image on the photosensitive drum 33 receives a bias voltage applied by the transfer roller 39 and is transferred to the recording paper P carried on the belt 16. Accordingly, the images in magenta, yellow, cyan, and black are formed in sequence on the recording paper P.

The recording paper P passing through the respective process units 7M, 7Y, 7C and 7B is carried to a fixing unit 41. In the fixing unit 41, the toner image formed on the recording paper P is sandwiched between a heating roller 43 and a pressing roller 45 and is heat-fused. The recording paper P on which the image is heat-fixed is further carried by a pair of paper discharge rollers 51, and is discharged onto a paper discharge tray 52 provided on an upper surface of the body frame 1.

As shown in FIG. 1, a locking mechanism 56 for locking the front panel 59 to the body frame 1 is provided above the front panel 59 of the body frame 1.

The locking mechanism 56 includes a claw 56*a* disposed on the body frame 1 and a solenoid 56*b* for activating the claw 56*a*. The solenoid 56*b* is controlled by a command from a control unit 81 (FIG. 4), described later. The claw 56*a* prevents the process casing 59*a* from detaching from the body frame 1 by being locked in a hole 59*c* on the front panel 59.

The locking mechanism 56 is brought into an unlocked state (OFF state) by being arranged at a position where the claw 56*a* is not locked in the hole 59*c* of the front panel 59 when the solenoid 56*b* is in a conductive state, and is brought into a locked state (ON state) by being arranged at a position where the claw 56*a* can be locked in the hole 59*c* of the front panel 59 when the solenoid 56*b* is in a non-conductive state. In other words, in the power OFF state in which a power is not supplied to the control unit 81 and the solenoid 56*b*, the locked state is secured. Accordingly, in the power ON state in which the power is supplied to the control unit 81, the solenoid 56*b* is conductive only when the control unit 81 determines that the lock may be released, so that the locking mechanism 56 is brought into the unlocked state (OFF state).

Detachment Control Unit

A detachment control unit will be described.

Figure 3A:
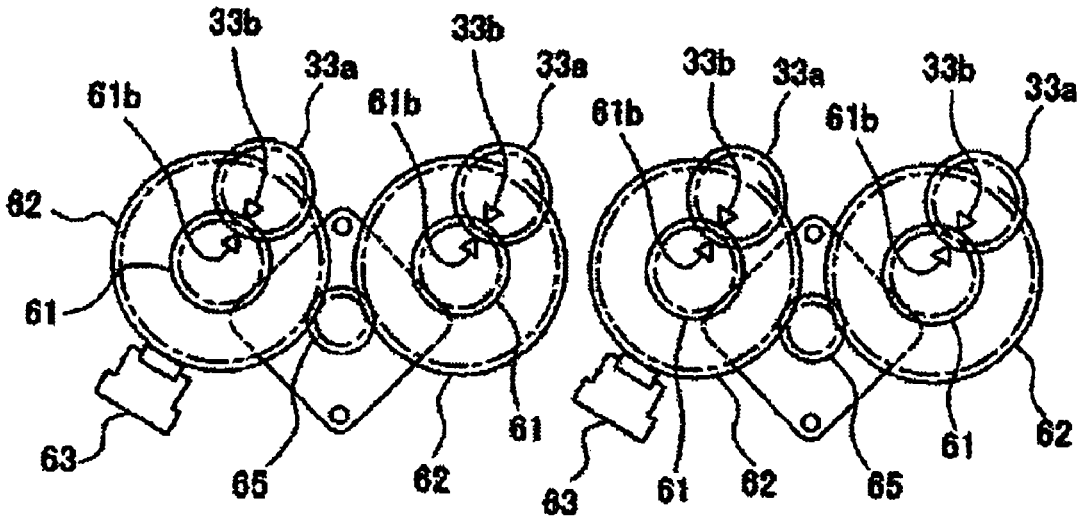
FIGS. 3A and 3B illustrate a state in which drum gears are at drum gear attachable/detachable positions, and drum drive gears are at drum drive gear attachable/detachable positions according to an illustrative aspect of the invention.
Figure 3B:
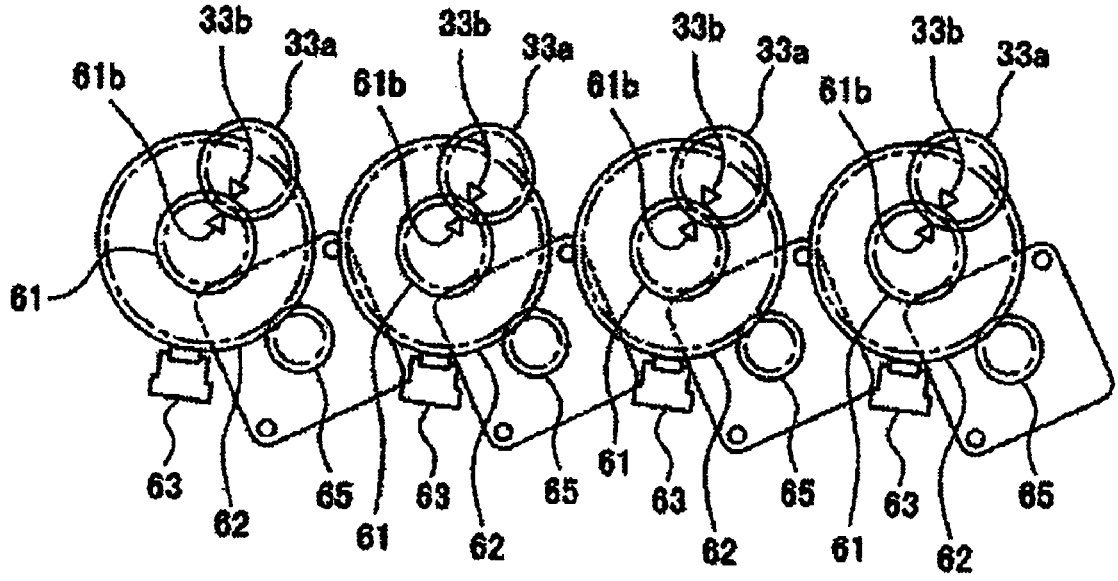
Figure 4:
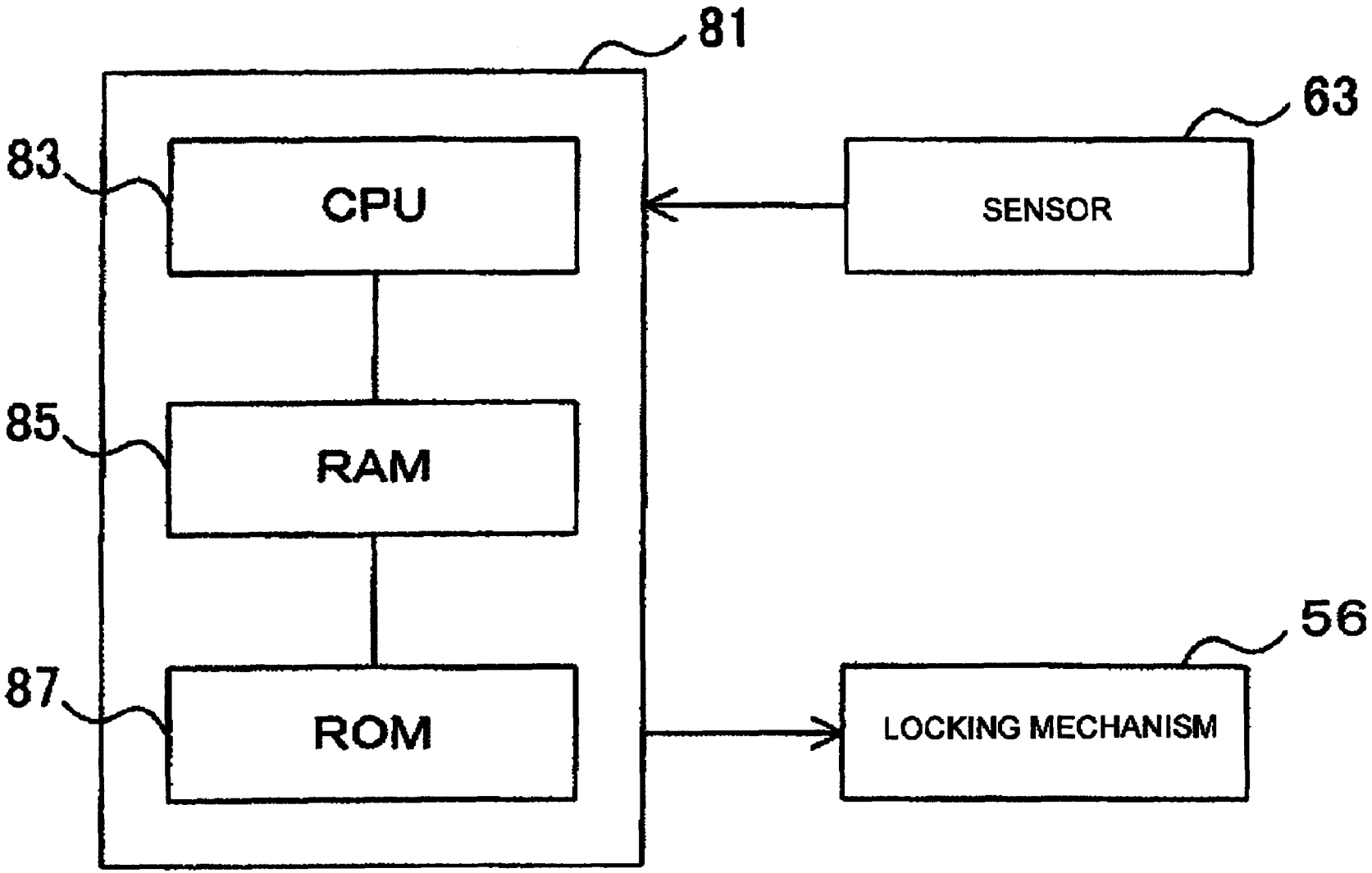
FIG. 4 is a block diagram showing an operation of a detachment control unit according to an illustrative aspect of the invention.

FIG. 3A and 3B illustrate a state in which drum gears 33*a* are at drum gear attachable/detachable positions, and drum drive gears 61 are at drum drive gear attachable/detachable positions. FIG. 4 is a block diagram showing an operation of the detachment control unit.

The detachment control unit includes a detection unit for detecting a rotational position of the drum drive gear 61 and a determination unit for determining an engaged position between the drum gear 33*a* and the drum drive gear 61 according to the detection signal from the detection unit.

A sensor 63 serves as the detection unit and is shown in FIGS. 3A and 3B. FIGS. 3A shows an example in which four drum drive gears 61 are driven by two motors 65, and the two sensors 63 are used for detecting the rotational position of the respective drum drive gears 61. FIG. 3B shows an example in which the four drum drive gears 61 are driven by four motors 65 specific thereto respectively, and the four sensors 63 are used for detecting the rotational position of the respective drum drive gears 61.

In this case, only the case shown in FIG. 3A will be described, and the detailed description relating to FIG. 3B will be omitted since it is the same except for the number of the sensors 63 and the motors 65.

In FIG. 3A, the drum gear 33*a* fixed at an end of each photosensitive drum 33 engages with the drum drive gear 61 provided in a main body of the image forming apparatus. The four drum gears 33*a* are formed by an identical molding die. The four drum drive gears 61 are formed by an identical molding die. Each drum gear 33*a* has a preset drum gear attachable/detachable position. Each drum drive gear 61 also has a preset drum drive gear attachable/detachable position.

The attachable/detachable position (a predetermined rotational position) of each of the drum gears 33*a* is a rotational position where the directions of shift or displacement of the drum gears 33*a* fixed to the respective photosensitive drums 33 match when transferring the developer images to an identical position on the paper P from the four photosensitive drums 33 respectively. The attachable/detachable position of the drum drive gear 61 is a rotational position where the directions of shift or displacement of the drum drive gears 61 match when the developer images which are to be transferred to an identical position on the paper P respectively from the four photosensitive drums 33 are transferred. In this positional relationship, the rotational speeds of the respective photosensitive drums 33 match when transferring the developer images to an identical position on the paper P from the four photosensitive drums 33 respectively. As such, occurrence of color drift of the developer image formed on the paper P can be suppressed.

The attachable/detachable position corresponds to a rotational position where triangle marks 33*b* and 61*b* which are shown on the respective gears 33*a* and 61 for convenience match in FIG. 3A. However, in the description shown below, the rotational position where the marks 33*b* and 61*b* match is described as the drum gear attachable/detachable position 33*b* and the drum drive gear attachable/detachable position 61*b*, respectively.

The drum drive gear 61 moves with a coaxially fixed intermediate gear 62, which is driven by a motor 65 provided in the main body of the image forming apparatus. The sensor 63 is disposed in the vicinity of a peripheral edge of the intermediate gear 62, and detects the rotational position of the drum drive gear 61. FIG. 3B shows a state in which the drum gear 33*a* is in the drum gear attachable/detachable position 33*b* as in FIG. 3A, and the drum drive gear 61 is in the drum drive gear attachable/detachable position 61*b*.

When the drum gear 33*a* is at the drum gear attachable/detachable position 33*b* and the drum drive gear 61 is at the drum drive gear attachable/detachable position 61*b*, the locking mechanism 56 is in the OFF state as shown in FIG. 2. Therefore, the user can remove the photosensitive drum 33 from an opening in a front portion of the body frame 1 together with the process casing 59*a*. FIG. 1 shows a case in which the locking mechanism 56 is in the ON state and hence the user cannot remove the process casing 59*a* from the body frame 1.

Operation of Detachment Control Unit

Figure 5:
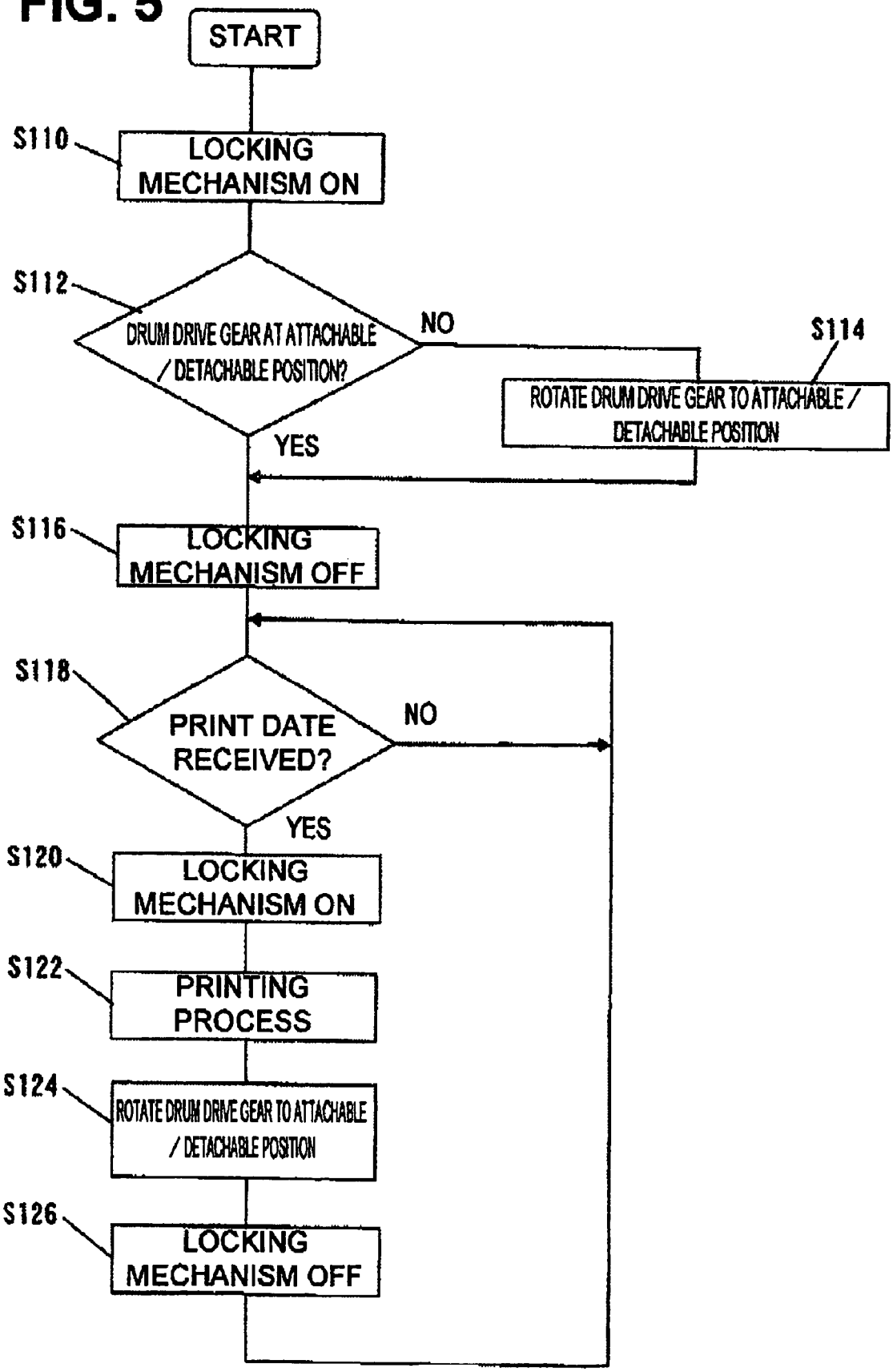
FIG. 5 is a flowchart showing the operation of the detachment control unit according to an illustrative aspect of the invention.

Referring to FIG. 4 and FIG. 5, an operation of the detachment control unit will be described. FIG. 5 is a flowchart showing the operation of the detachment control unit.

The operation of the detachment control unit is performed by an ON/OFF command issued to the locking mechanism 56 outputted from the control unit 81 which receives a detection signal from the sensor 63 as shown in FIG. 4. The control unit 81 is provided in the main body of the image forming apparatus and computes the detection signal from the sensor 63 which detects the rotational position of the drum drive gear 61 and provides a command to the locking mechanism 56 based on the computed result. The control unit 81 includes a CPU 83, a RAM 85 and a ROM 87.

The CPU 83 performs a computation upon receipt of an input signal from the sensor 63, and provides a command to the locking mechanism 56 based on the computation result. The RAM 85 is a random access memory device for temporarily storing data or the like for the calculating process and the ROM 87 is a read only memory device in which the procedure of the computation process or the like is stored.

Referring to a flowchart shown in FIG. 5, an operation system of the detachment control unit will be described.

In the flowchart shown in FIG. 5, when power is turned ON, the locking mechanism 56 is first brought into the ON state in step S110. In other words, when the power of the image forming apparatus is in the OFF state, the locking mechanism 56 is in the ON state, and in S110, the locking mechanism 56 remains in the ON state. Accordingly, the user cannot detach the process casing 59*a* from the body frame 1.

Subsequently, whether the drum gear 33*a* and the drum drive gear 61 are in the attachable/detachable positions is determined in S112. More specifically, whether the drum gear 33*a* and the drum drive gear 61 are at the attachable/detachable positions shown in FIG. 3A can be determined based on the detection signal from the sensor 63, and if they are at the attachable/detachable positions, the result in S112 is YES. If so, the procedure immediately goes to S116, where the locking mechanism 56 is turned OFF.

However, when the drum gear 33*a* and the drum drive gear 61 are not in the attachable/detachable positions in a state in which the power is turned ON, the result in S112 is NO, and the procedure goes to S114, where the drum gear 33*a* and the drum drive gear 61 are rotated to the attachable/detachable positions. More specifically, the motor 65 is driven until the drum drive gear 61 is rotated to the attachable/detachable position shown in FIG. 3A based on the detection signal from the sensor 63. Then, the procedure goes to S116, where the locking mechanism 56 is turned OFF, and a print command is issued from an external device, for example, a host computer or the like connected to the color laser printer 100 (S118).

In the OFF state of the locking mechanism 56, the user can detach the process casing 59*a* from the body frame 1 as needed.

When a print command is received from the external device, that is, if YES in S118, the locking mechanism 56 is turned ON in S120 first, and the drive of the motor 65 is controlled to perform the printing process. Therefore, when the printing process is being performed, the drum gear 33*a* and the drum drive gear 61 are not in the attachable/detachable positions, and hence the process casing 59*a* can be prevented from being detached from the body frame 1 together with the photosensitive drum 33. Consequently, the color drift of the overlaid developer images can be prevented from occurring due to the unknown rotational positions of the four drum drive gears 61.

When the printing process is ended, for example in response to a print command from an external device, the motor 65 continues to be driven until the drum gear 33*a* and the drum drive gear 61 reach the attachable/detachable positions in S124.

When it is confirmed that the drum gear 33*a* and the drum drive gear 61 are stopped at the attachable/detachable positions based on the detection signal from the sensor 63, the locking mechanism 56 is turned OFF in S126, and then the procedure returns to S118 to wait for the print command from the external device.

Even when a sudden power blockage or the like occurs during preparation for printing or during the printing process, the locking mechanism 56 is turned ON in association with the power blockage. As a result, the process casing 59*a* can be prevented from being detached from the body frame 1.

In this arrangement, even when the gear system is stopped due to a sudden power blockage or the like, the photosensitive drum 33 can be prevented from being removed from the main body of the image forming apparatus so that the engaged position between the drum drive gear 61 and the drum gear 33*a* can be maintained.

Installation of the photosensitive drum 33 in the main body of the image forming apparatus can be enabled only when the rotational positions of the four drum drive gears 61 are at the drum drive gear attachable/detachable position 61*b*.

Rotating Member and Guiding Member

A rotating member 33*c* and a guiding member 110 are described in detail.

Figure 6:
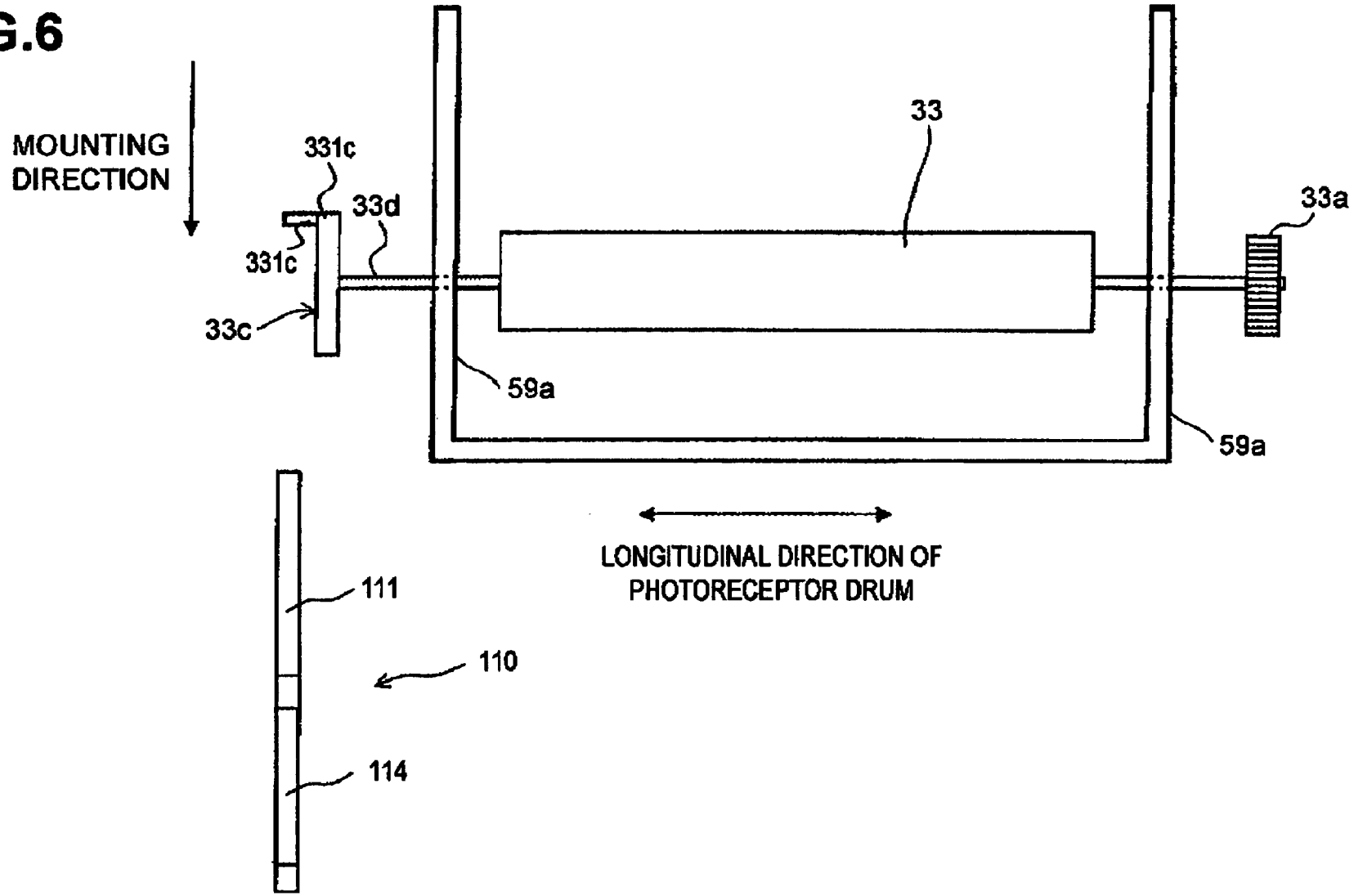
FIG. 6 depicts a view of the process casing looking up from the bottom of a body frame when the process casing is attached to the body frame according to an illustrative aspect of the invention.

FIG. 6 depicts a view of the process casing 59*a* looking up from the bottom of the body frame 1 when the process casing 59*a* is attached to the main body frame 1.

The body frame 1 is provided with the guiding member 110 for positioning the respective drum gears 33*a* in the drum gear attachable/detachable positions, and the process casing 59*a* is provided with a rotating member 33*c* which is guided by coming into contact with the guiding member 110 as shown in FIG. 6.

A rotating shaft 33*d* of the photosensitive drum 33 is rotatably supported by the process casing 59*a*.

The drum gear 33*a*, which transmits a drive force from the motor as a drive source to the photosensitive drum 33, is fixed to an end of the rotating shaft 33*d*. The rotating member 33*c* is fixed to the other end of the rotating shaft 33*d* so as to rotate with the drum gear 33*a*.

The rotating member 33*c* includes a disc shaped base member 331*c* coupling to the rotating shaft 33*d*, and a cylindrically shaped protrusion 330*c* projecting in the longitudinal direction of the photosensitive drum 33 from a surface of the base member 331*c*. The protrusion 330*c* is arranged at a position away from a center axis of rotation of the photosensitive drum 33.

Figure 7:
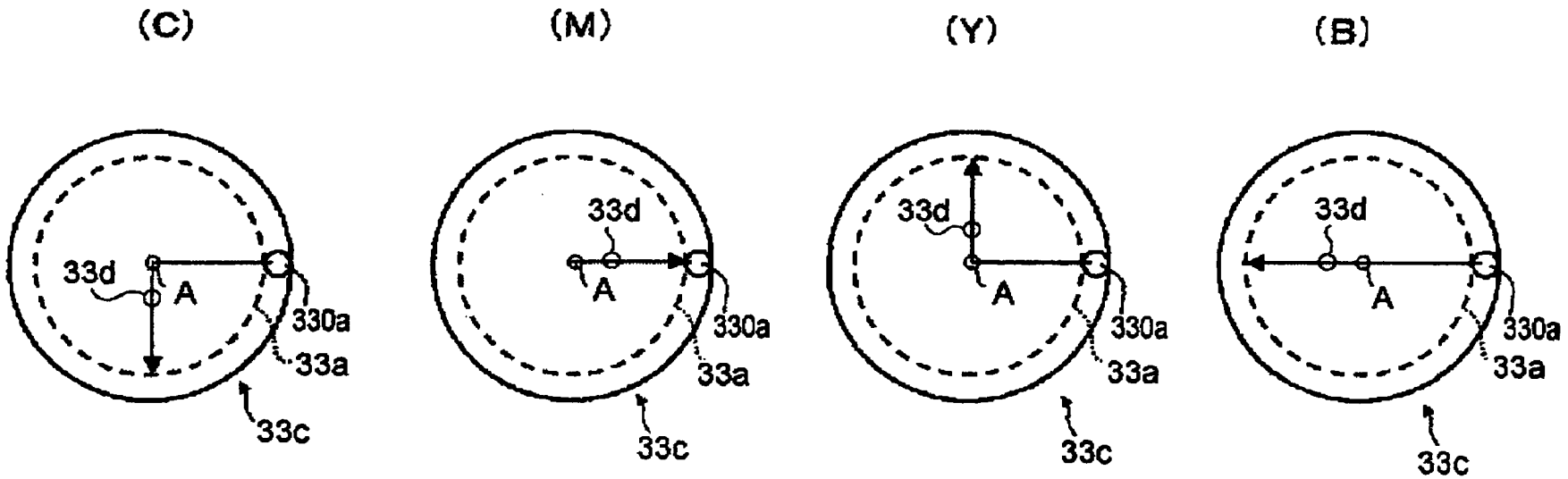
FIG. 7 is a plan view of rotating members viewed from the side of an end of a rotating shaft according to an illustrative aspect of the invention.

FIG. 7 is a plan view of the respective rotating members 33*c* viewed from the side of the rotating shaft 33*d*.

Due to constraints of manufacturing, the rotating shafts 33*d* of the four photosensitive drums 33 are typically shifted or displaced away from the central axis A of the respective drum gears 33*a*. To account for the shift, each rotating shaft 33*d* of each respective drum gear 33*a* is positioned away from the central axis A in a respective predetermined direction (shown by arrows) as shown in FIG. 7.

More specifically, the four rotating members 33*c* are in a positional relationship such that the drum gears 33*a* are arranged at the drum gear attachable/detachable positions when all the protrusions 330*c* are located in front of the rotating shafts 33*d* (the direction opposite from the attaching direction of the process casing 59*a* to the body frame 1).

Figure 8:
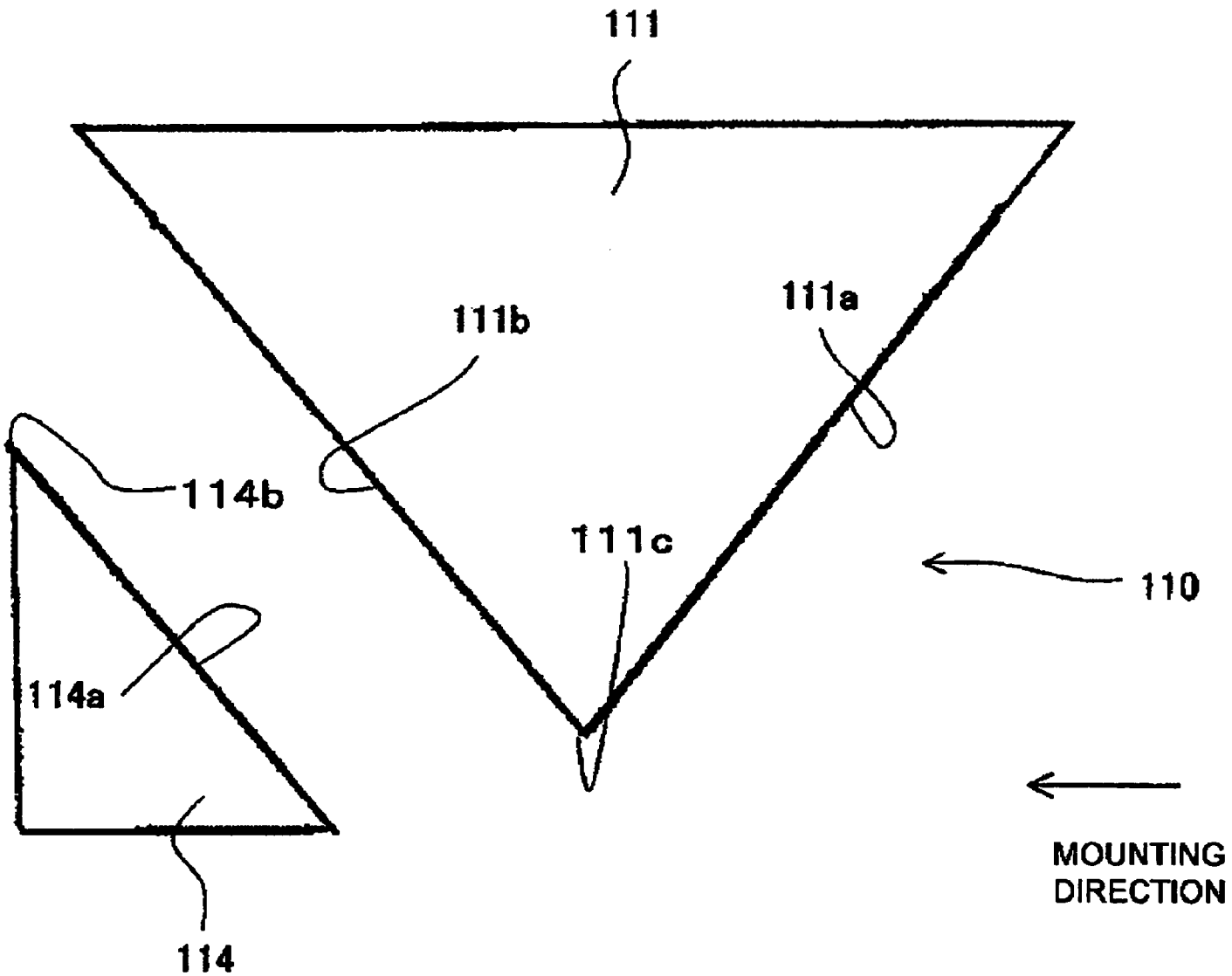
FIG. 8 is an enlarged cross-sectional view of a guiding member in FIG. 1 according to an illustrative aspect of the invention.

FIG. 8 is an enlarged cross-sectional view of the guiding member 110 in FIG. 1.

The guiding member 110 is coupled to the body frame 1, and includes an inverted triangular first guiding member 111 arranged in front and a triangular second guiding member 114 arranged on the back (in the attachment direction of the process casing 59*a* to the body frame 1). The first guiding member 111 includes a first guiding surface 111*a* for guiding the rotating member 33*c* by contacting the protrusion 330*c* during attachment of the process casing 59*a* to the body frame 1 and a third guiding surface 111*b* for guiding the rotating member 33*c* by coming into contact with the protrusion 330*c* when detaching the process casing 59*a* from the body frame 1.

Figure 9A:
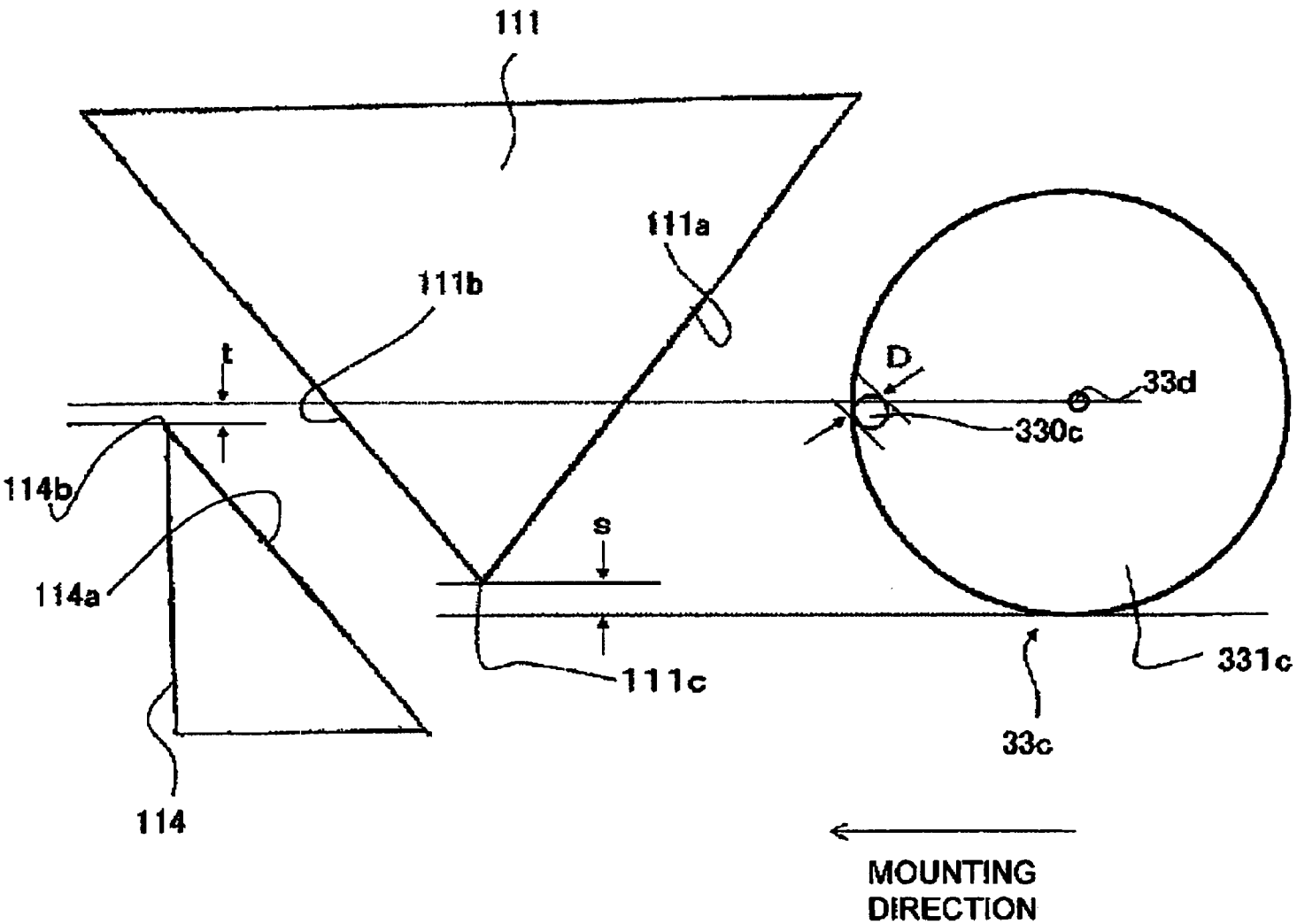
FIG. 9A is a plan view showing a state before a protrusion comes into contact with a first guiding member according to an illustrative aspect of the invention.

The second guiding member 114 includes a second guiding surface 114*a* for guiding the rotating member 33*c* by coming into contact with the protrusion 330*c* during attachment of the process casing 59*a* to the body frame 1. FIGS. 9A to 9G are plan views showing a state in which the protruding member 33 is guided by the guiding member 110 during attachment of the process casing 59*a*. A distance s between a lower end 111*c* of the first guiding surface 111*a* and a lower end of a peripheral surface of the base member 331*c* in the vertical direction (the direction orthogonal to the attachment or installation direction) is equal to a diameter D of the protrusion 330*c* as shown in FIG. 9A. A distance t between an upper end 114*b* of the second guiding surface 114*a* and an axis of rotation of the photosensitive drum 33 in the vertical direction is equal to the radius of the protrusion 330*c*.

Figure 9B:
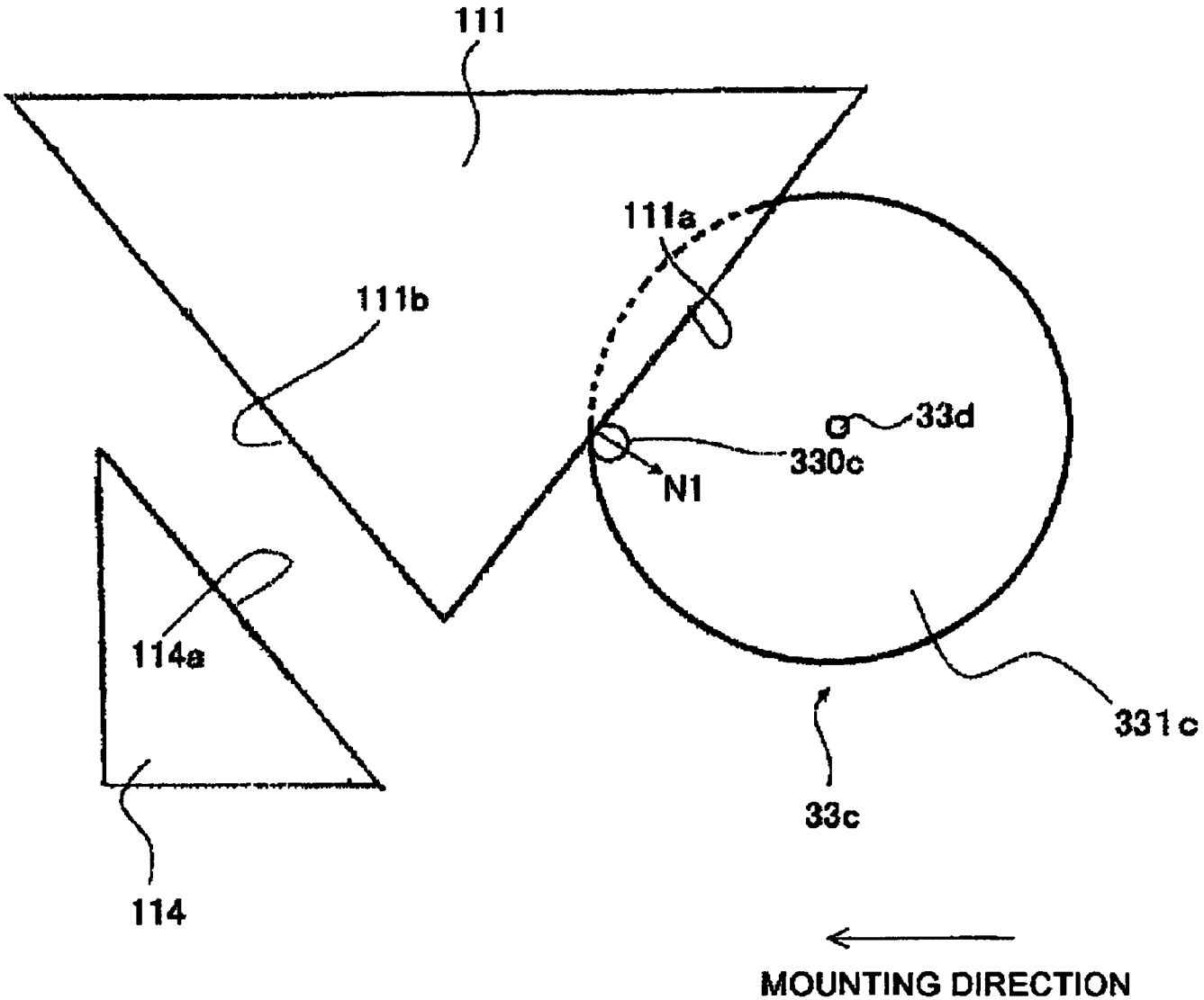
FIG. 9B is a plan view showing a state in which the protrusion comes into contact with the first guiding member according to an illustrative aspect of the invention.
Figure 9C:
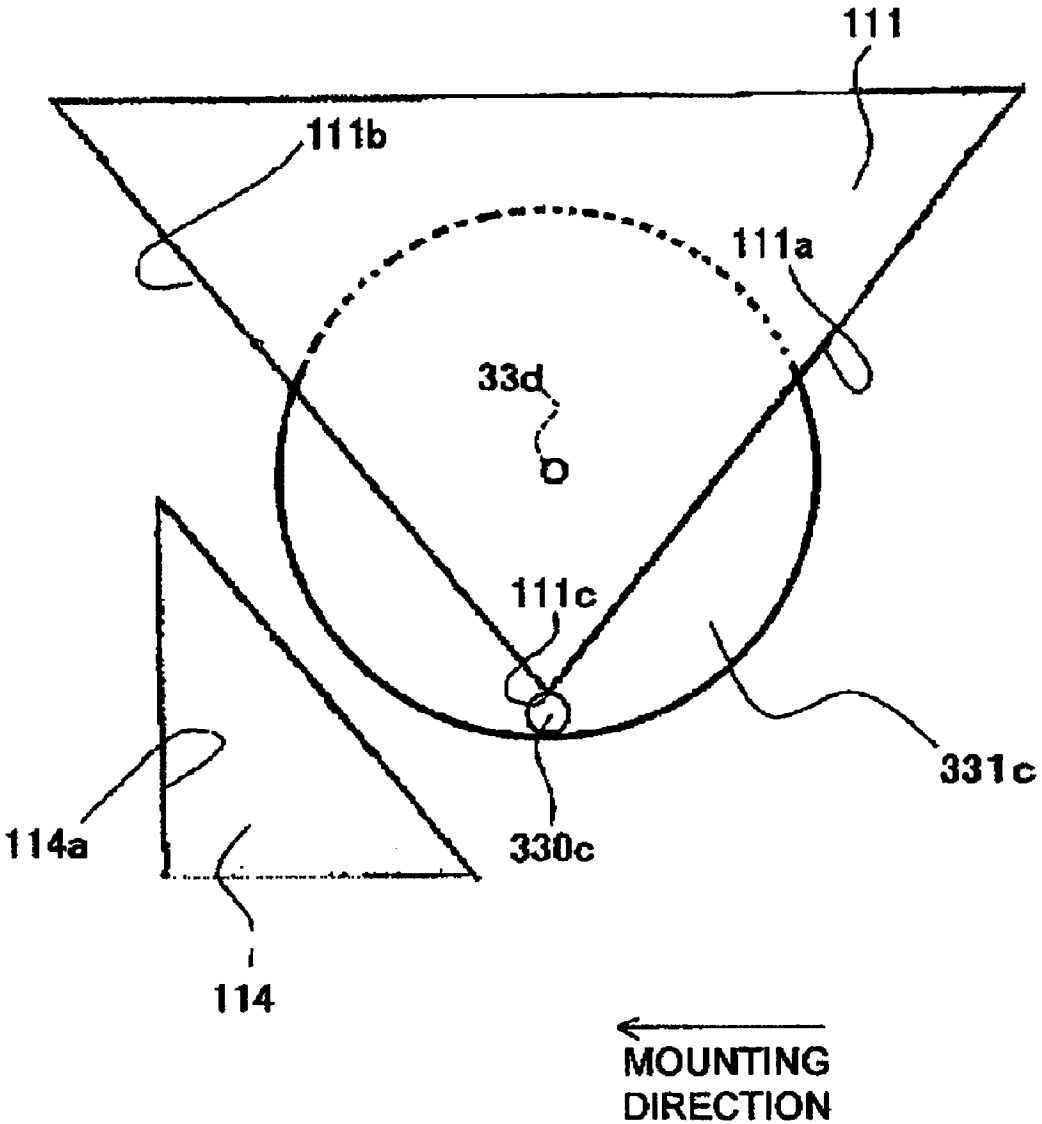
FIG. 9C is a plan view showing a state in which the protrusion is located at a position vertically below the rotating shaft according to an illustrative aspect of the invention.
Figure 9D:
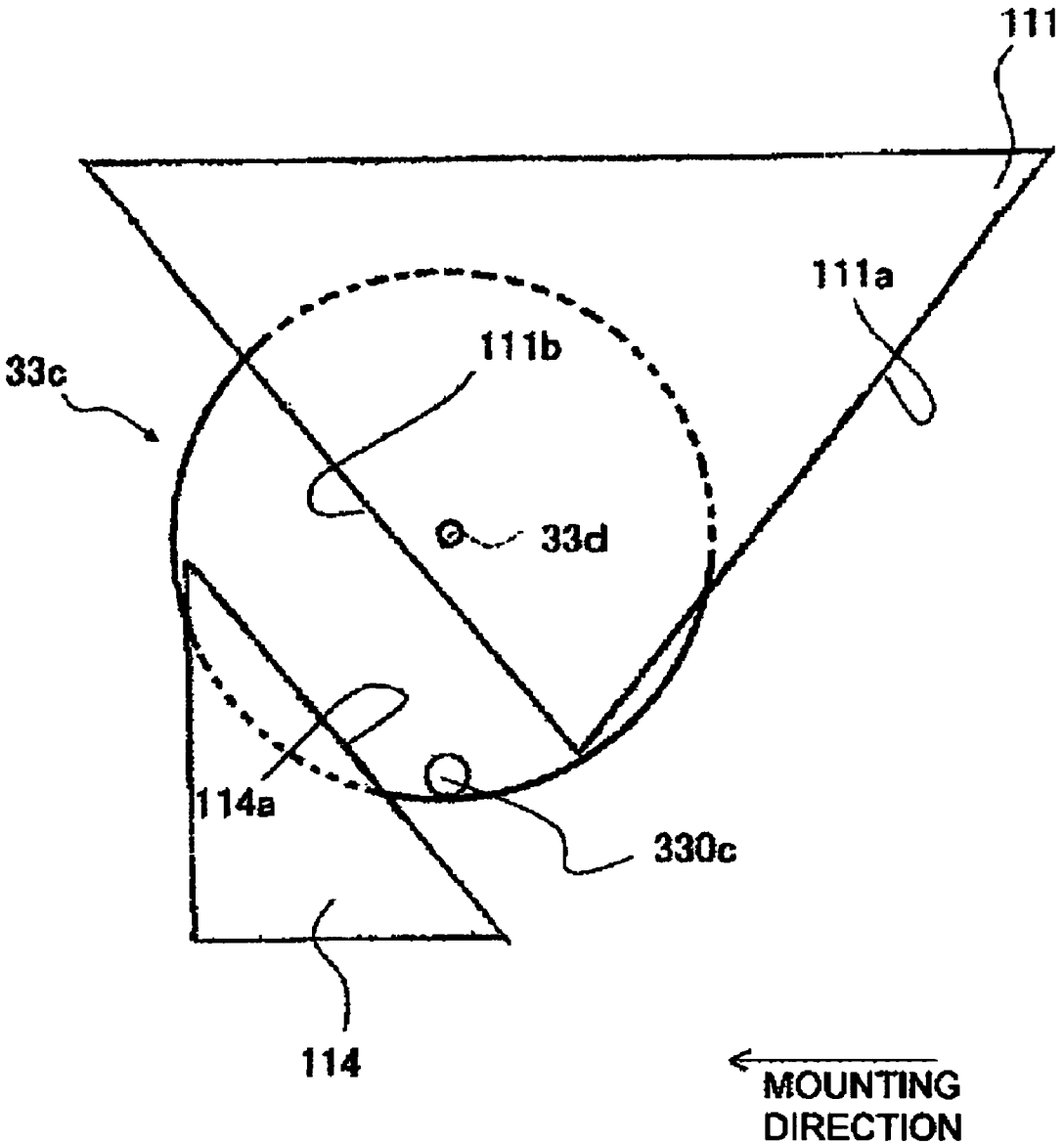
FIG. 9D is a plan view showing a state of the protrusion after having passed through the first guiding surface and before coming into contact with a second guiding member according to an illustrative aspect of the invention.
Figure 9E:
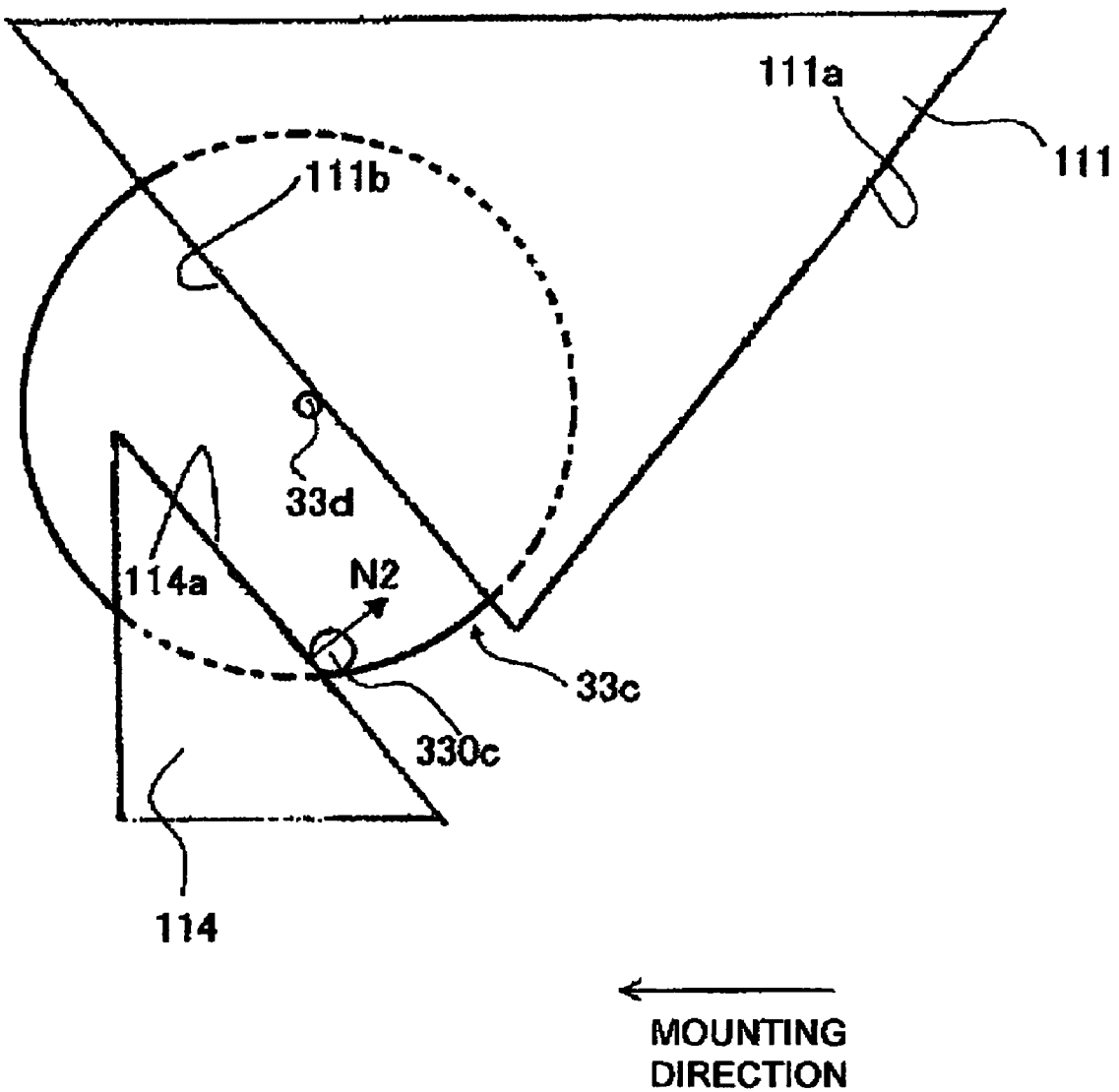
FIG. 9E is a plan view showing a state in which the protrusion comes into contact with the second guiding member according to an illustrative aspect of the invention.
Figure 9F:
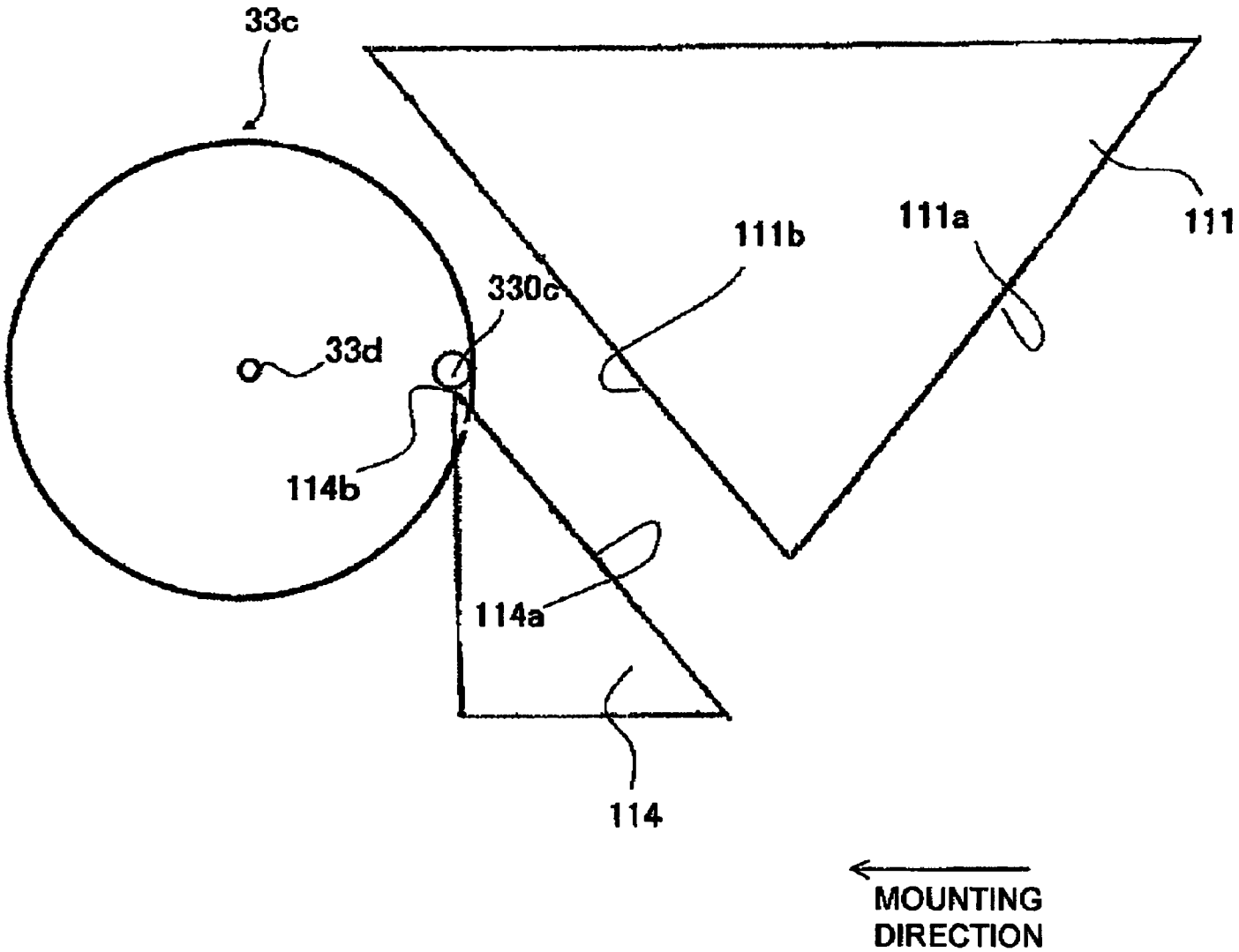
FIG. 9F is a plan view showing a state in which the protrusion is located at a position vertically above an upper end of the second guiding member according to an illustrative aspect of the invention.
Figure 9G:
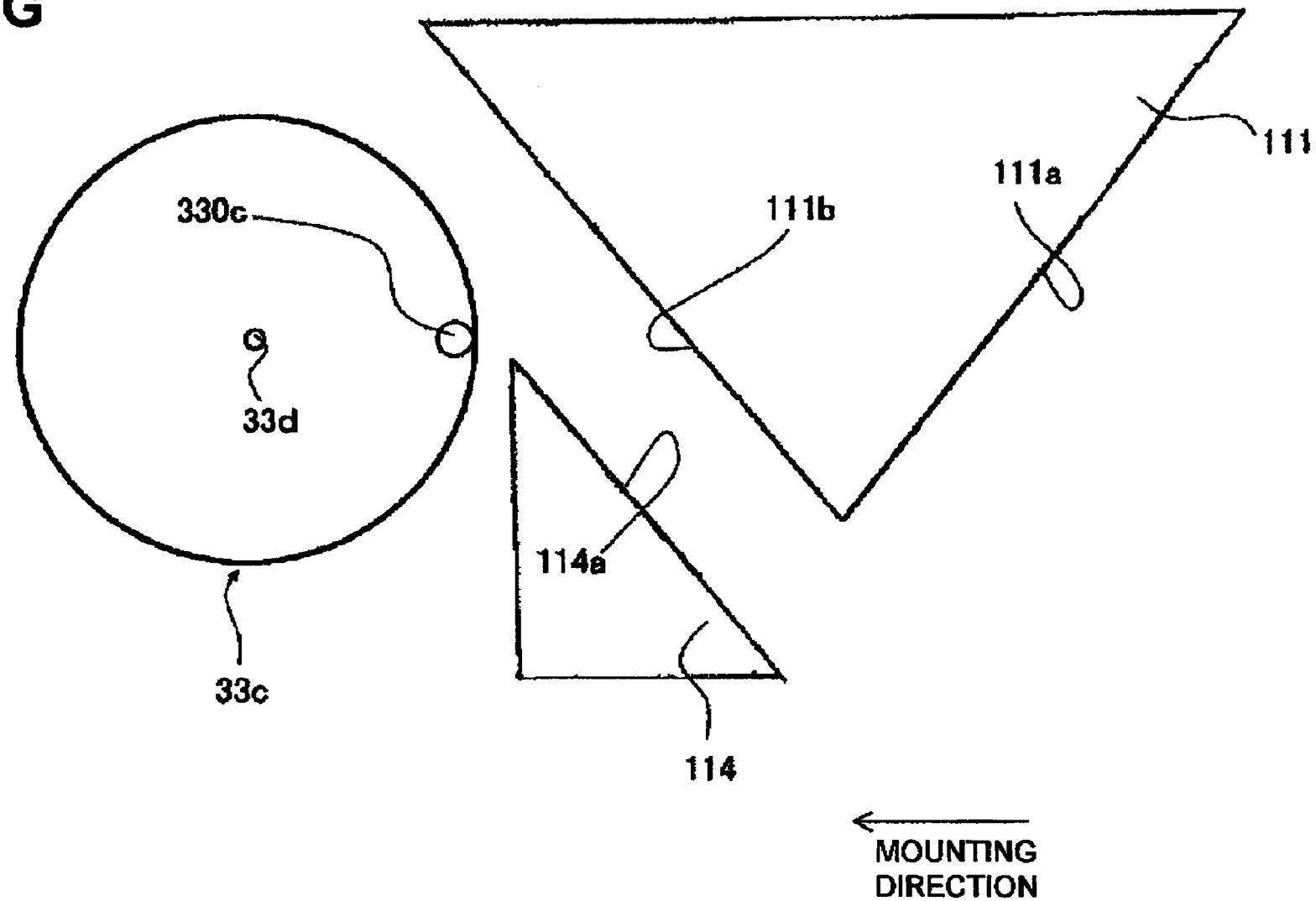
FIG. 9G is a plan view showing a state of the protrusion after having passed the second guiding member according to an illustrative aspect of the invention.

When the protrusion 330*c* approaches the first guiding member 111 in a state of being positioned behind the rotating shaft 33*d* as shown in FIG. 9A and contacts the first guiding surface 111*a* of the first guiding member 111 as shown in FIG. 9B, the rotating member 33*c* rotates counterclockwise about the rotating shaft 33*d* while receiving a force N1 from the first guiding surface 111*a*. When the rotating shaft 33*d* is moved to a position vertically above the lower end 111*c* of the first guiding surface 111*a* as shown in FIG. 9C, the rotating member 33*c* is guided to a position where the protrusion 330*c* is located at a rotational position vertically below the rotating shaft 33*d*. Even when the rotating shaft 33*d* is moved further rearward as shown in FIG. 9D, the protrusion 330*c* maintains the relative positional relationship with the rotating shaft 33*d* until it comes into contact with the second guiding member 114. When the process casing 59*a* moved further rearward, it comes into contact with the second guiding surface 114*a* of the second guiding member 114 and rotates counterclockwise in about the rotating shaft 33*d* while receiving a force N2 as shown in FIG. 9E. When the rotating shaft 33*d* is moved to a position vertically above the upper end 114*b* of the second guiding surface 114*a* as shown in FIG. 9F, the rotating member 33*c* is guided to a rotational position where the protrusion 330*c* is located in front of the rotating shaft 33*d*. As shown in FIG. 9G, after having passed through the upper end 114*b*, the protrusion 330*c* maintains the same relative position with respect to the rotating shaft 33*d*.

The protrusions 330*c* of the rotating members 33*c* coupled to the four photosensitive drums 33 respectively are arranged in front of the rotating shafts 33*d* the same manner. In this manner, the drum gears 33*a* which rotate with the rotating members 33*c* are arranged at the drum gear attachable/detachable positions.

The case in which the protrusion 330*c* is positioned behind the rotating shaft 33*d* before the protrusion 330*c* comes into contact with the first guiding member 111 has been described thus far. However, even though the protrusion 330*c* is at other positions, when it comes into contact with the first guiding surface 111*a*, the rotating member 33*c* is guided to a rotational position where the protrusion 330*c* is located vertically below the rotating shaft 33*d*. When the protrusion 330*c* comes into contact with the second guiding member 114, the rotating member 33*c* is guided to a rotational position where the protrusion 330*c* is located in front of the rotating shaft 33*d*. In other words, the rotating member 33*c* is guided to the rotational position where the protrusion 330*c* is located in front of the rotating shaft 33*d* by being guided by the guiding member 110 irrespective of the initial rotational position. In this manner, the drum gear 33*a* which rotates with the rotating member 33*c* is arranged at the drum gear attachable/detachable position. For example, as shown in FIG. 2, even when the positions of the respective protrusions 330*c* with respect to the respective rotating shafts 33*d* are different in a state in which the process casing 59*a* has been removed from the body frame 1, the protrusions 330*c* are registered at positions in front of the respective rotating shafts 33*d* by guiding member 110 as shown in FIG. 1.

Effect of Configuration of Rotating Member and Guiding Member

The effect of the configurations of the rotating member 33*c* and the guiding member 110 will be described.

Even when the process casing 59*a* is removed from the body frame 1, since the drum gears 33*a* are registered at the drum gear attachable/detachable positions by the rotating members 33*c* being guided by the guiding member 110 when being attached again, the color drift can be suppressed.

Since the attaching/detaching direction of the process casing 59*a* is orthogonal to the longitudinal direction of the drums and the protrusions 330*c* protrude to longitudinal direction of the photosensitive drums 33, the length of the process casing 59*a* orthogonal to the longitudinal direction does not affect the contact between the protrusions 330*c* and the guiding member 110. Therefore, it is not necessary to set the amount of protrusion of the protrusions 330*c* to be long while considering the length of the process casing 59*a* orthogonal to the longitudinal direction.

The protrusion 330*c* can be arranged outside the process casing 59*a* by coupling the base member 331*c* to the other end of the rotating shaft 33*d* protruding toward the outside of the process casing 59*a*.

When attaching the process casing 59*a*, the protrusion 330*c* of the rotating member 33*c* is guided to be below, e.g., vertically below, the rotating shaft 33*d* by the first guiding surface 111*a* of the first guiding member 111, and then the protrusion 330*c* is guided to the front of the rotating shaft 33*d* by the second guiding surface 114*a* of the second guiding member 114. In other words, since the protrusion 330*c* is guided to a position where it can come into contact with the second guiding member 114 firstly by the first guiding member 111, the drum gear 33*a* can be guided to the drum gear attachable/detachable position by bringing the protrusion 330*c* into contact with the second guiding member 114.

Since the first guiding member 111 includes the third guiding surface 111*b* which guides the rotating member 33*c* by coming into contact with the protrusion 330*c* while detaching the process casing 59*a* from the body frame 1, detaching the process casing 59*a* can be achieved easily.

The direction of arrangement of the four photosensitive drums 33 matches the attachable/detachable direction of the process casing 59*a* with respect to the body frame 1. The four photosensitive drums 33 pass through a common area when being attached, which can make a single guiding member sufficient.

EXAMPLE 2

Subsequently, Example 2 will be described below. In Example 2, the configuration of a guiding member 120 is different from Example 1, and other portions are the same as Example 1. Therefore, the description of parts which are the same will be omitted for brevity.

Figure 10:
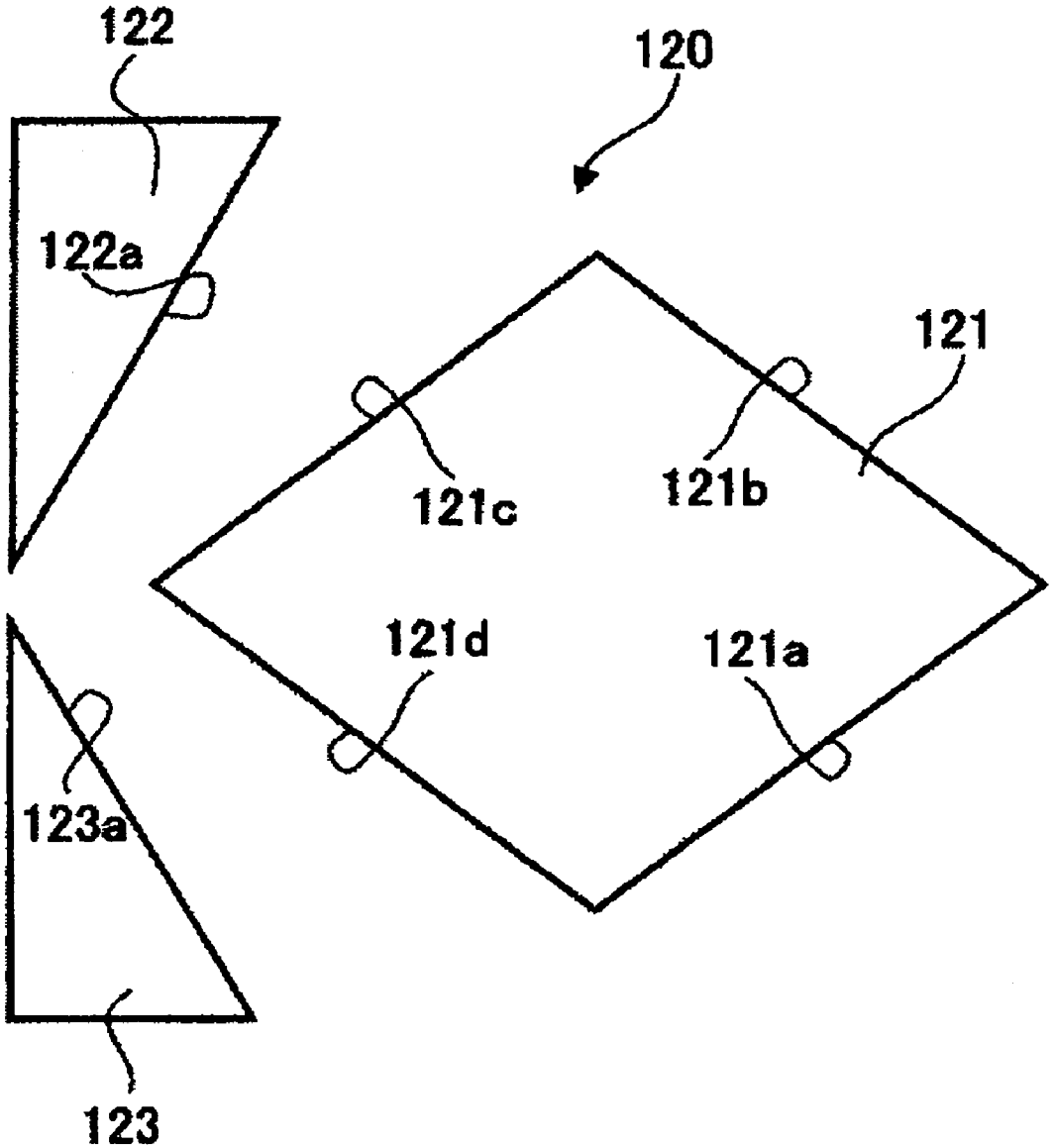
FIG. 10 is an enlarged plan view of a guiding member according to an illustrative aspect of the invention.

FIG. 10 is an enlarged plan view of the guiding member 120.

The guiding member 120 is coupled to the body frame 1 and includes a first guiding member 121 of a diamond shape arranged on the front side or face and second guiding members 122 and 123 of an inverted rectangular shape and a rectangular shape on a back side or face as shown in FIG. 10.

The first guiding member 121 includes first guiding surfaces 121*a* and 121*b* which come into contact with the protrusion 330*c* during attachment of the process casing 59*a* and third guiding surfaces 121*c* and 121*d* that come into contact with the protrusion 330*c* during detachment of the process casing 59*a* from the body frame 1.

The second guiding member 122 includes a second guiding surface 122*a* that comes into contact with the protrusion 330*c* during attachment of the process casing 59*a* to the body frame 1.

The second guiding member 123 includes a second guiding surface 123*a* that comes into contact with the protrusion 330*c* during attachment of the process casing 59*a* to the body frame 1.

FIG. 11A to 11G are plan views showing a state of the protruding member 33 guiding member 120 during attachment of the process casing 59*a*.

Figure 11A:
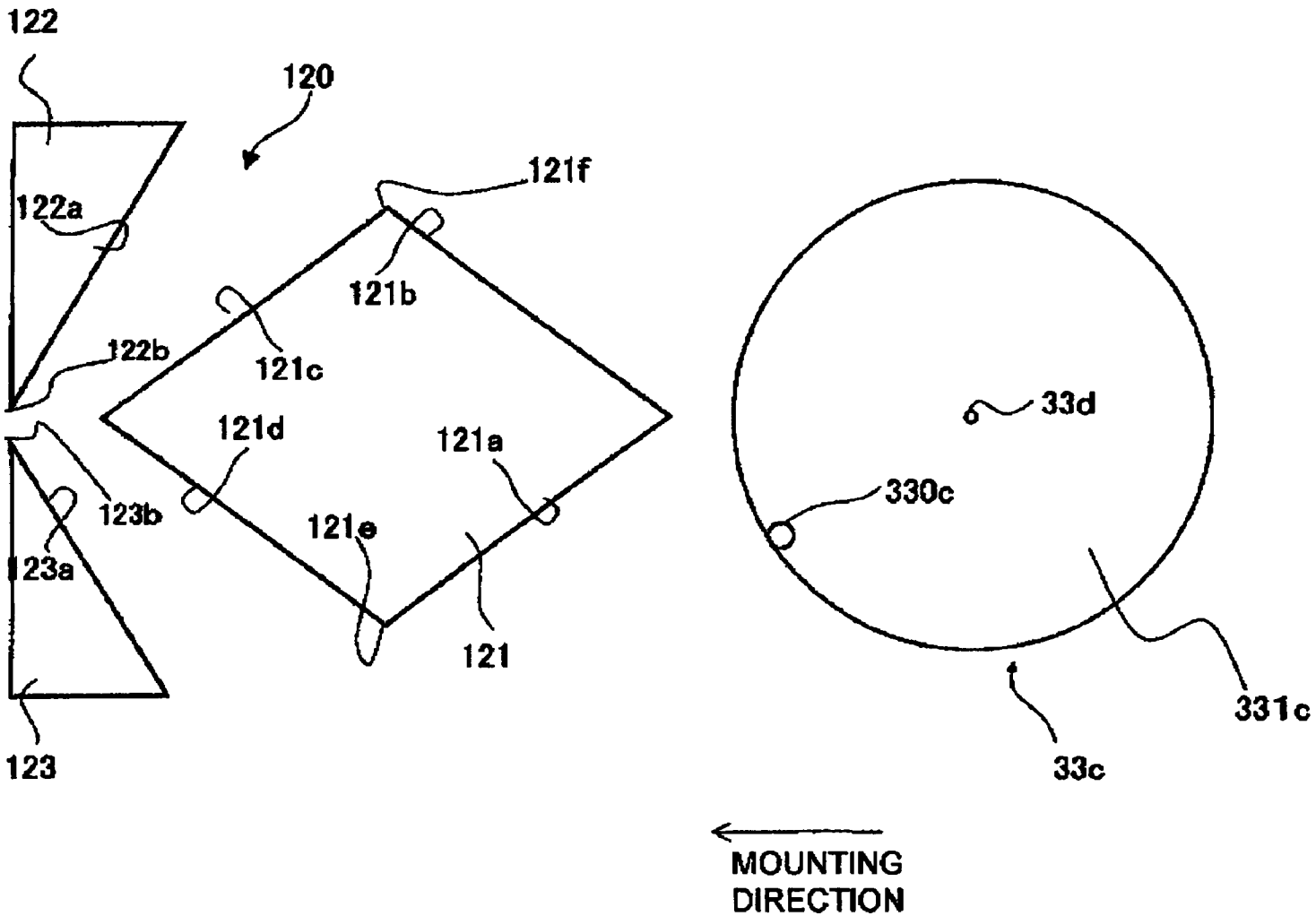
FIG. 11A is a plan view showing a state of the protrusion before coming into contact with a first guiding member according to an illustrative aspect of the invention.
Figure 11B:
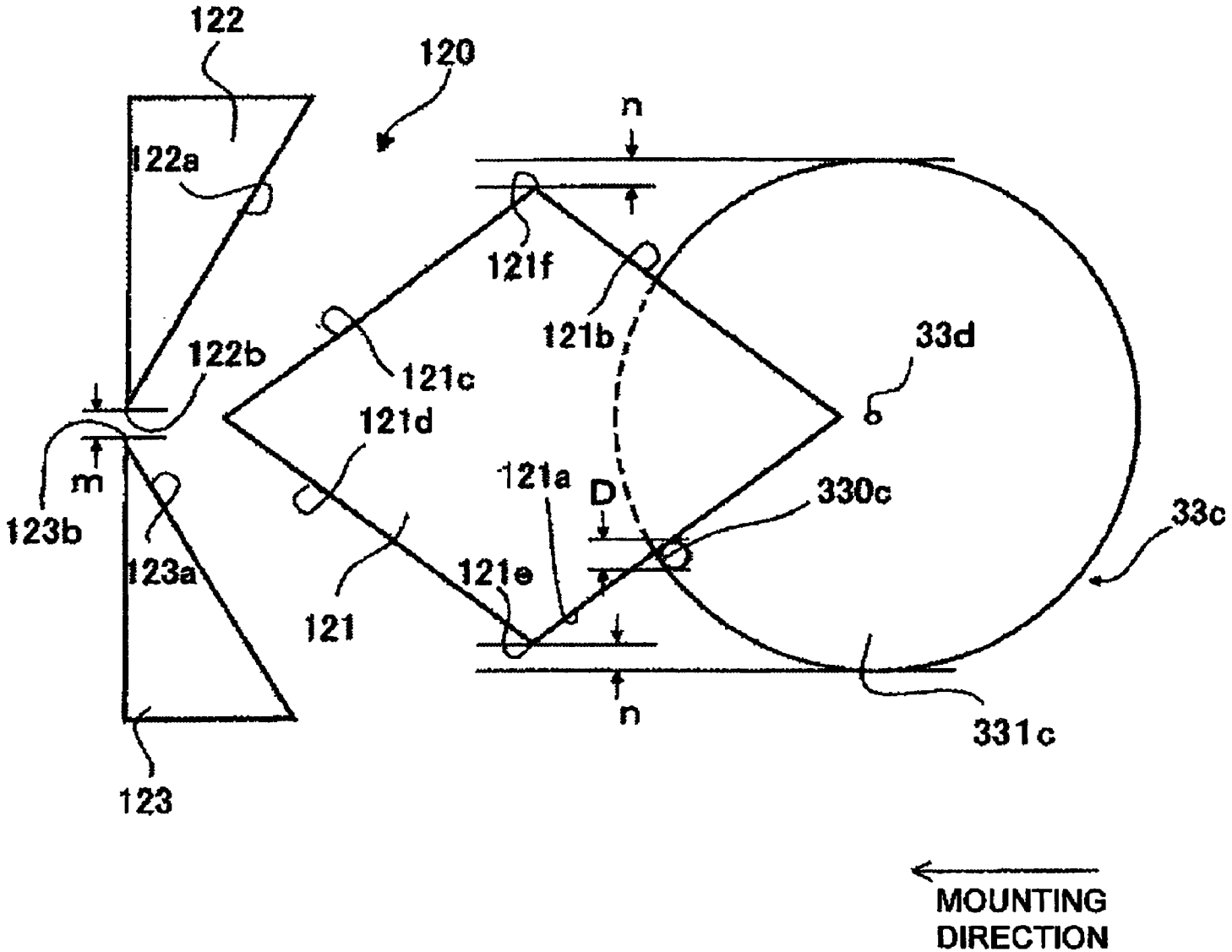
FIG. 11B is a plan view showing a state in which the protrusion is in contact with the first guiding member according to an illustrative aspect of the invention.

As shown in FIG. 11B, a distance n between a lower end 121*e* of the first guiding surface 121*a* and the lower end of the peripheral surface of the base member 331*c* in the vertical direction is equal to the diameter D of the protrusion 330*c*. In the same manner, the distance n in the vertical direction between an upper end 121*f* of the first guiding surface 121*b* and an upper end of the peripheral surface of the base member 331*c* is also equal to the diameter of the protrusion 330*c*. A distance m in the vertical direction between an upper end 123*b* of the second guiding surface 123*a* of the guiding member 123 and a lower end 122*b* of the second guiding surface 122*a* of the guiding member 122 is also equal to the diameter of the protrusion 330*c*.

Figure 11C:
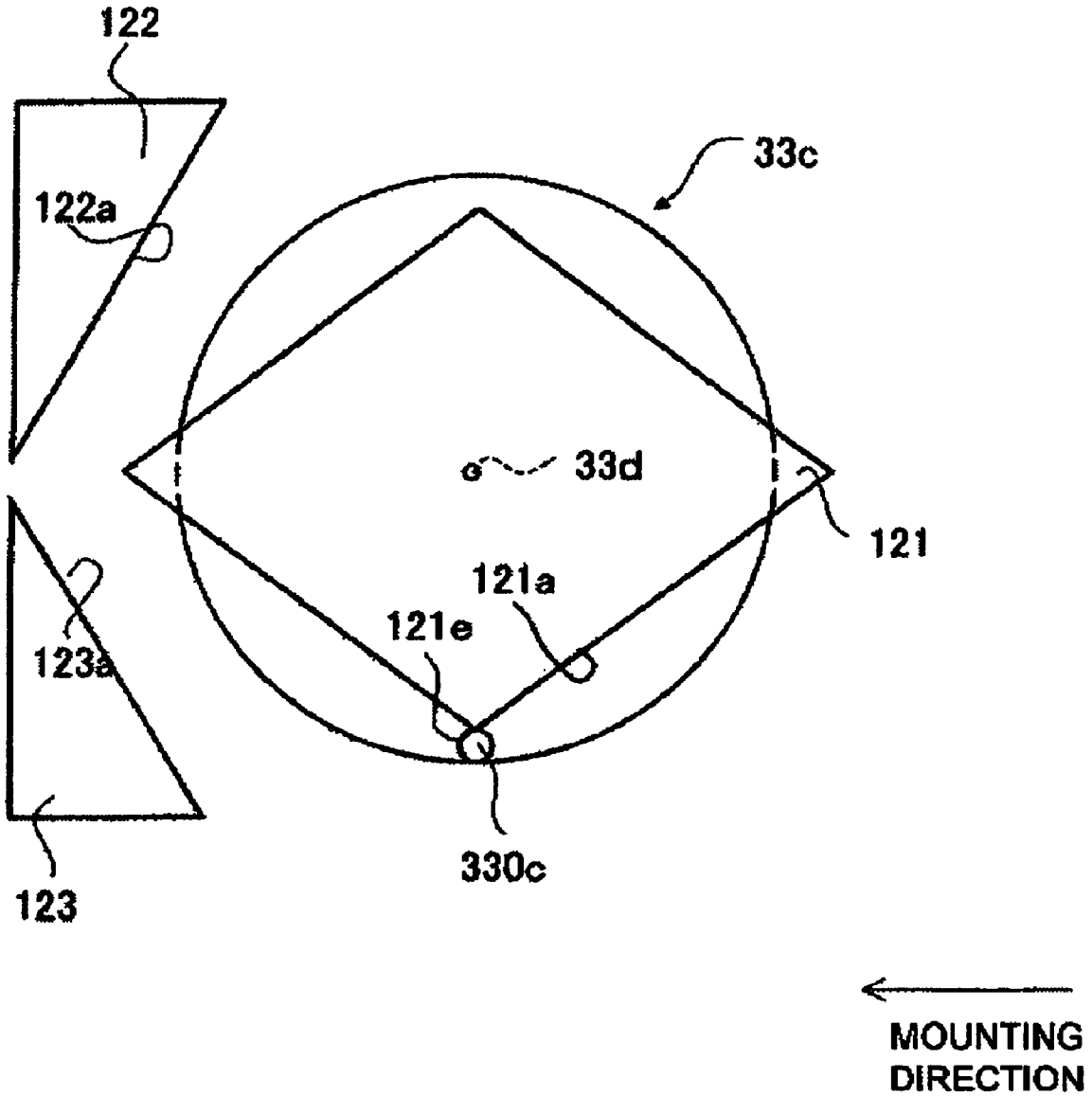
FIG. 11C is a plan view showing a state in which the protrusion is located at a position vertically below the rotating shaft according to an illustrative aspect of the invention.
Figure 11D:
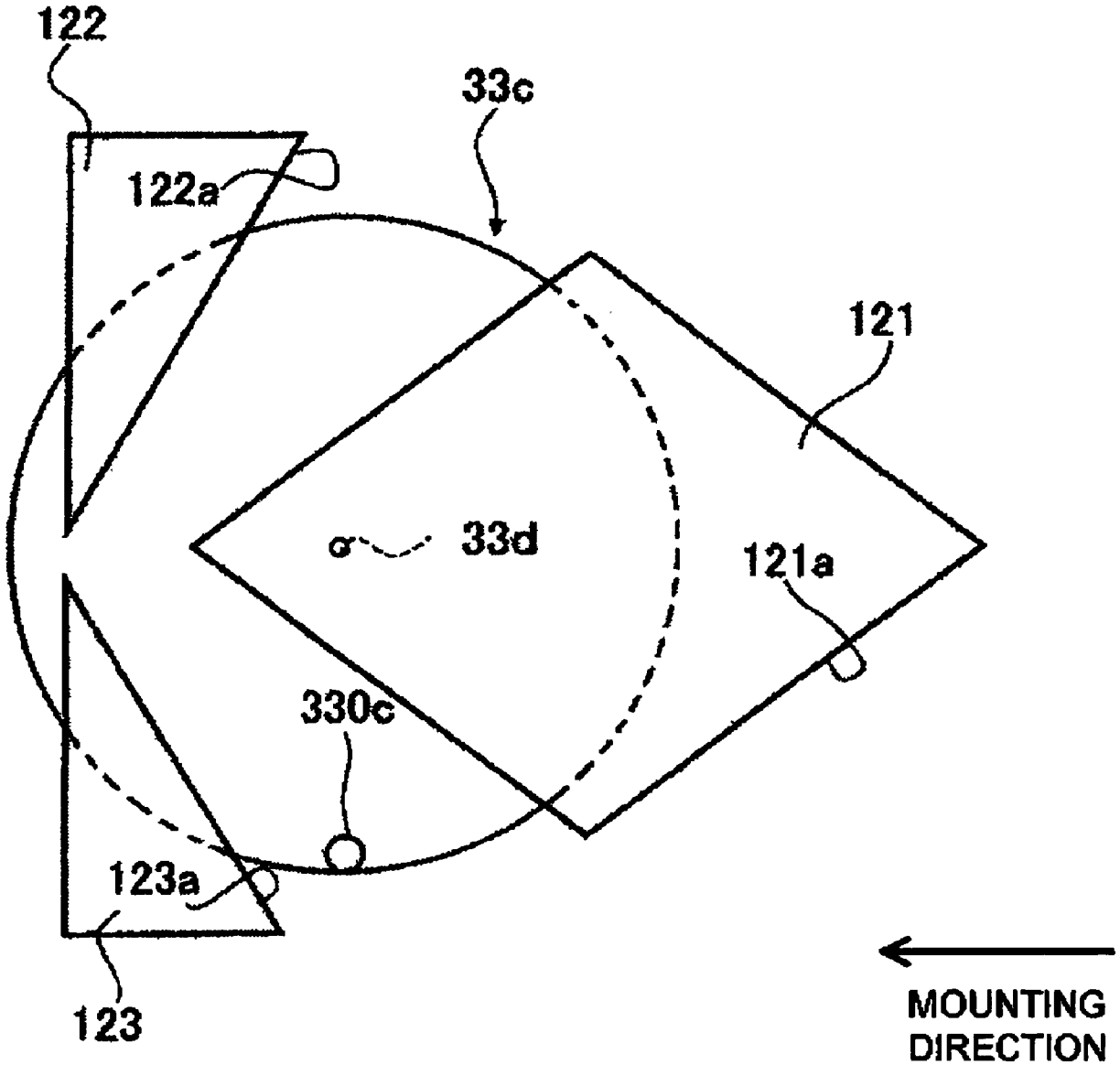
FIG. 11D is a plan view showing a state of the protrusion after having passed through a first guiding surface and before coming into contact with a second guiding member according to an illustrative aspect of the invention.
Figure 11E:
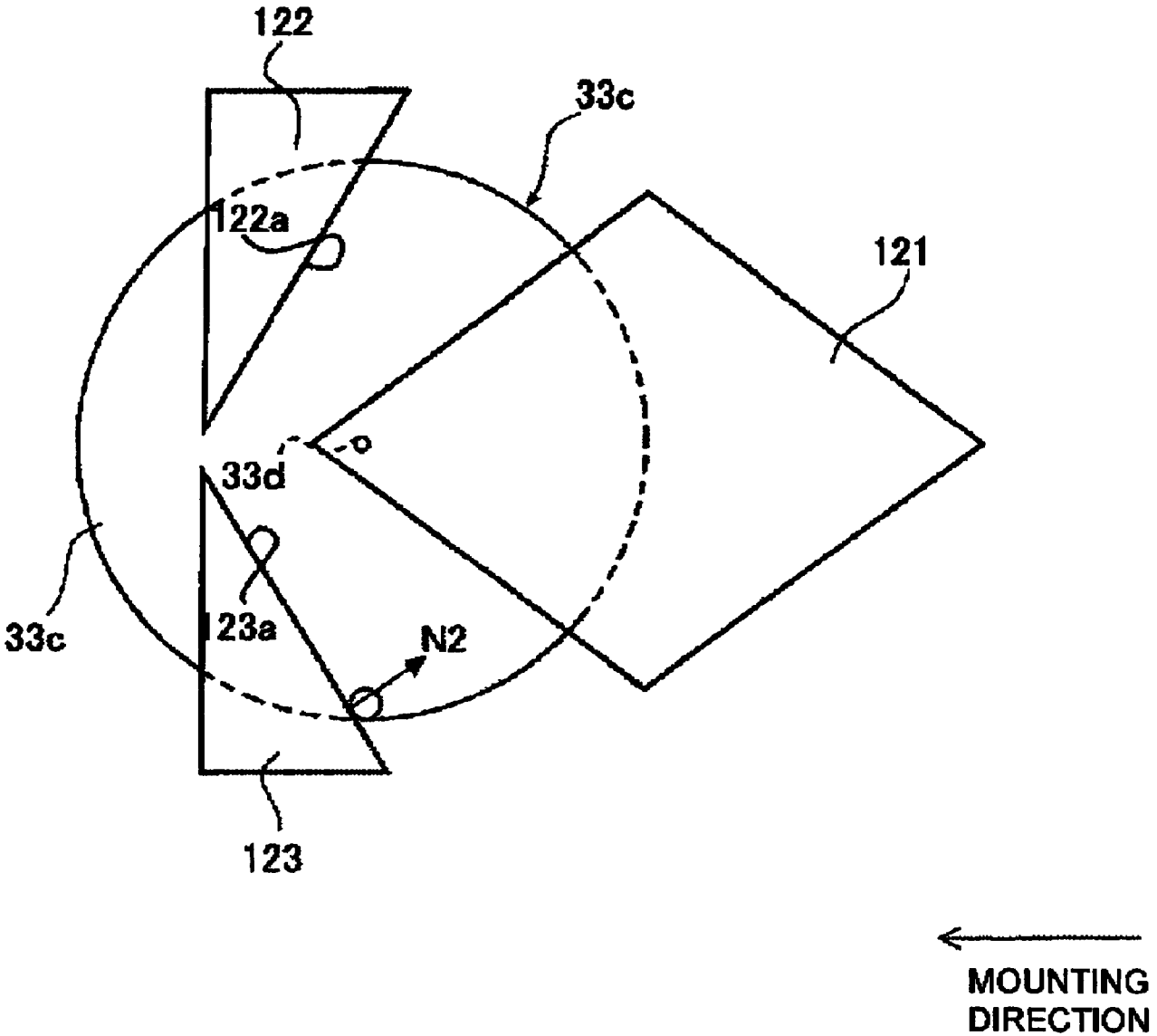
FIG. 11E is a plan view showing a state in which the protrusion comes into contact with the second guiding member according to an illustrative aspect of the invention.
Figure 11F:
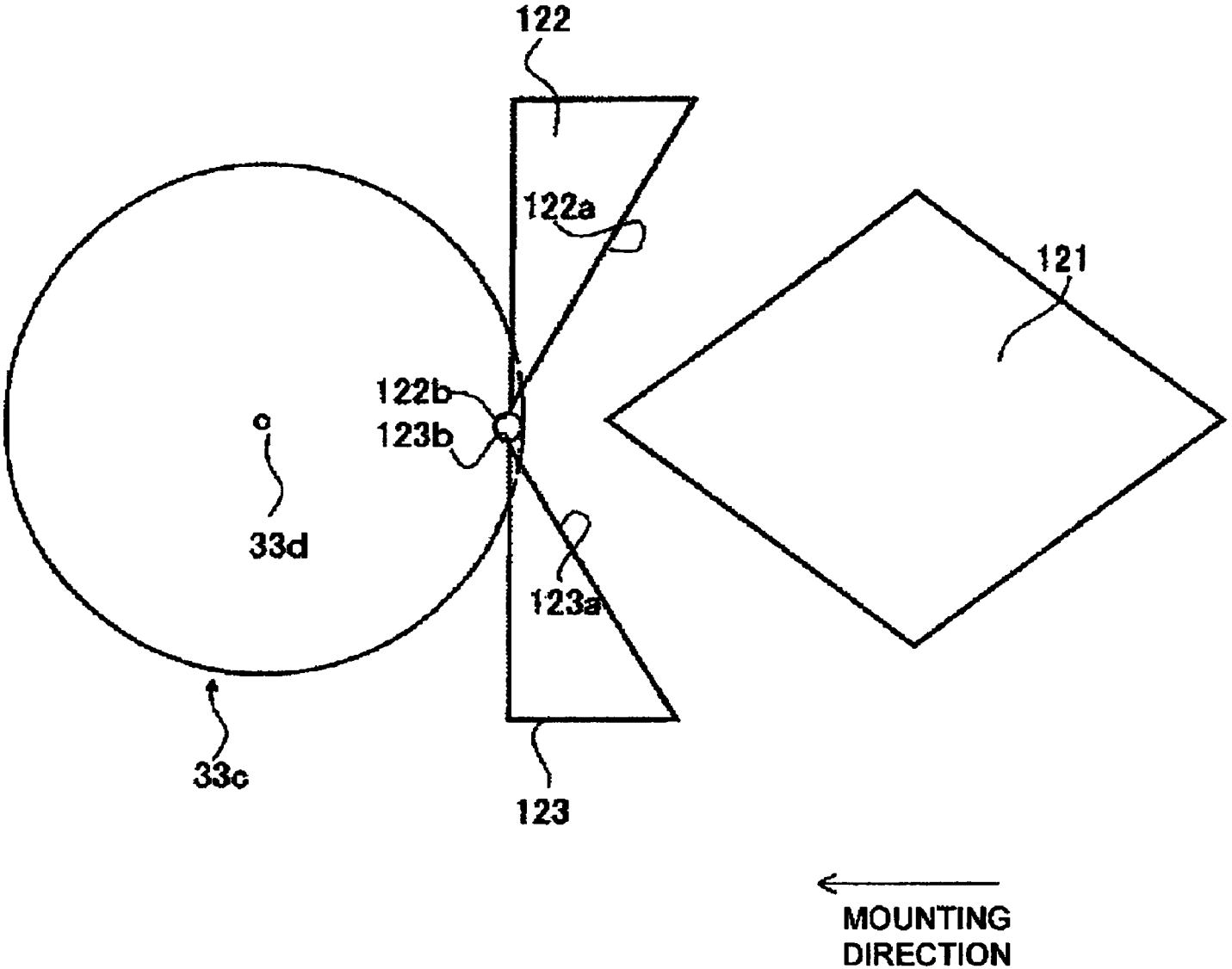
FIG. 11F is a plan view showing a state in which the protrusion is located vertically above an upper end of the second guide member according to an illustrative aspect of the invention.
Figure 11G:
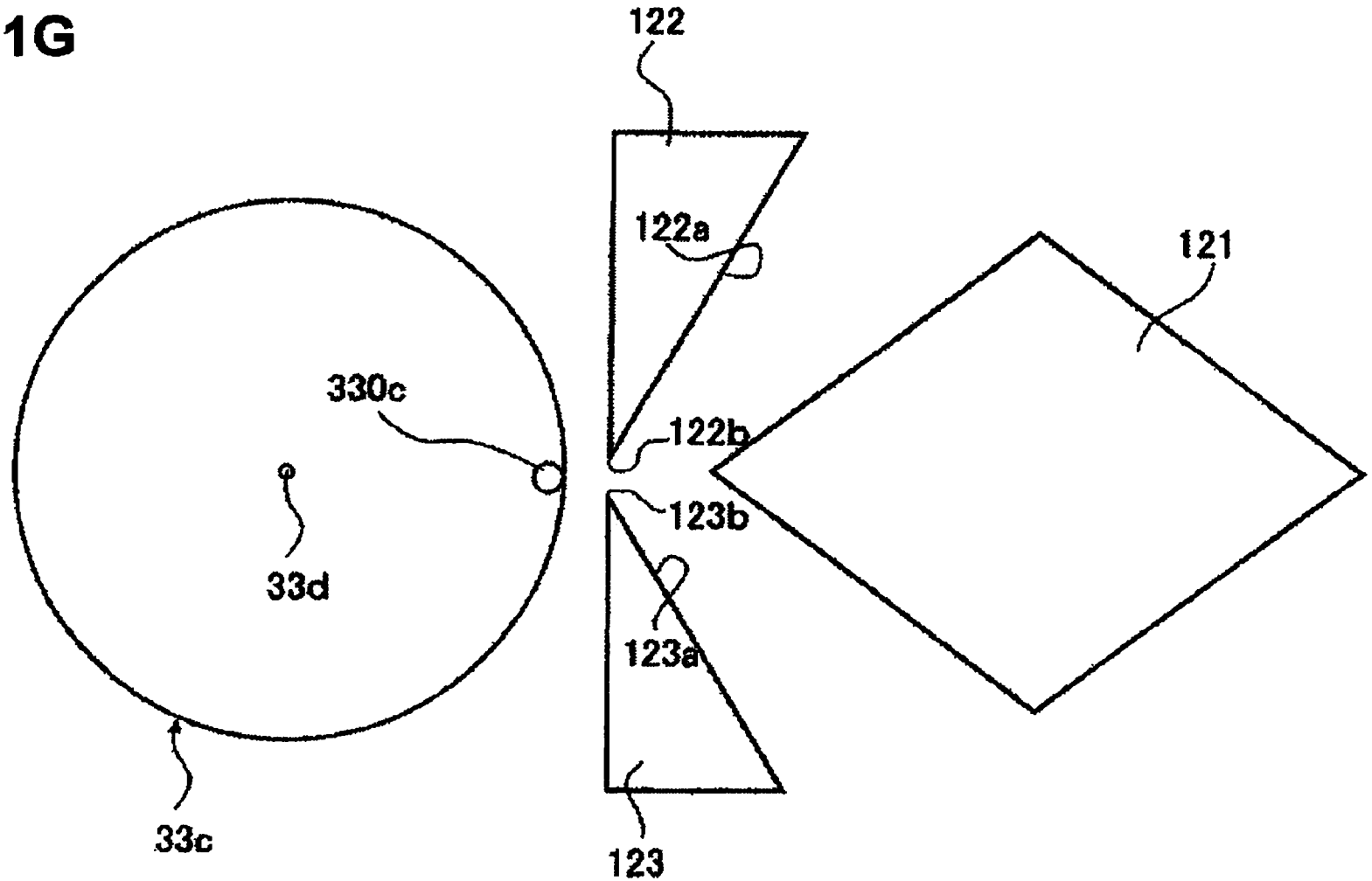
FIG. 11G is an enlarged plan view showing a state in which the protrusion passes through the second guiding member according to an illustrative aspect of the invention.

When the protrusion 330*c* approaches the first guiding member 121 when positioned below a horizontal line and to the left of a vertical line each intersecting the rotating shaft 33*d* as shown in FIG. 11A, and then comes into contact with the first guiding surface 121*a* of the first guiding member 121 as shown in FIG. 11B, the rotating member 33*c* rotates counterclockwise about the rotating shaft 33*d* while receiving the force N1 from the first guiding surface 121*a*. When the rotating shaft 33*d* is moved to a position vertically above the lower end 121*e* of the first guiding surface 111*a* as shown in FIG. 11C, the rotating member 33*c* is guided to a rotational position where the protrusion 330*c* is located vertically below the rotating shaft 33*d*. Even when the rotating shaft 33*d* is moved further rearward as shown in FIG. 11D, the protrusion 330*c* maintains the same relative position with respect to the rotating shaft 33*d* until it comes into contact with the second guiding member 123. When the process casing 59*a* is moved further rearward, it comes into contact with the second guiding surface 123*a* of the second guiding member 123 and rotates counterclockwise about the rotating shaft 33*d* while receiving the force N2 as shown in FIG. 11E. As shown in FIG. 11F, when the rotating shaft 33*d* is moved to a position horizontally spaced from the upper end 123*b* of the second guiding surface 123*a*, the rotating member 33*c* is guided to the rotational position where the protrusion 330*b* is located in front of the rotating shaft 33*d*. As shown in FIG. 11G, the protrusion 330*c* maintains the same relative position with respect to the rotating shaft 33*d* also after having passed through the upper end 123*b*.

The protrusions 330*c* of the rotating members 33*c* fixed to the four respective photosensitive drums 33 are arranged in front of the rotating shafts 33*d* the same manner. In this manner, the drum gears 33*a* which rotate with the rotating member 33*c* can be arranged at the drum gear attachable/detachable position.

When the protrusion 330*c* is located above the rotating shaft 33*d* before the protrusion 330*c* comes into contact with the guiding member 121, the protrusion 330*c* is guided by the first guiding surface 121*b* and the second guiding surface 122*a* of the second guiding member 122 in the same manner.

Since the second guiding members 122 and 123 are arranged such that the distance m between the lower end 122*b* of the second guiding member 122 and the upper end 123*b* of the second guiding member 123 can be equal to the diameter of the protrusion 330*c*, the protrusion 330*c* can be registered further accurately.

EXAMPLE 3

Example 3 will be described. In Example 3, the configuration of a guiding member 130 is different from Example 1, while other portions are the same as Example 1. Therefore, description of the parts which are the same will be omitted for brevity.

Figure 12:
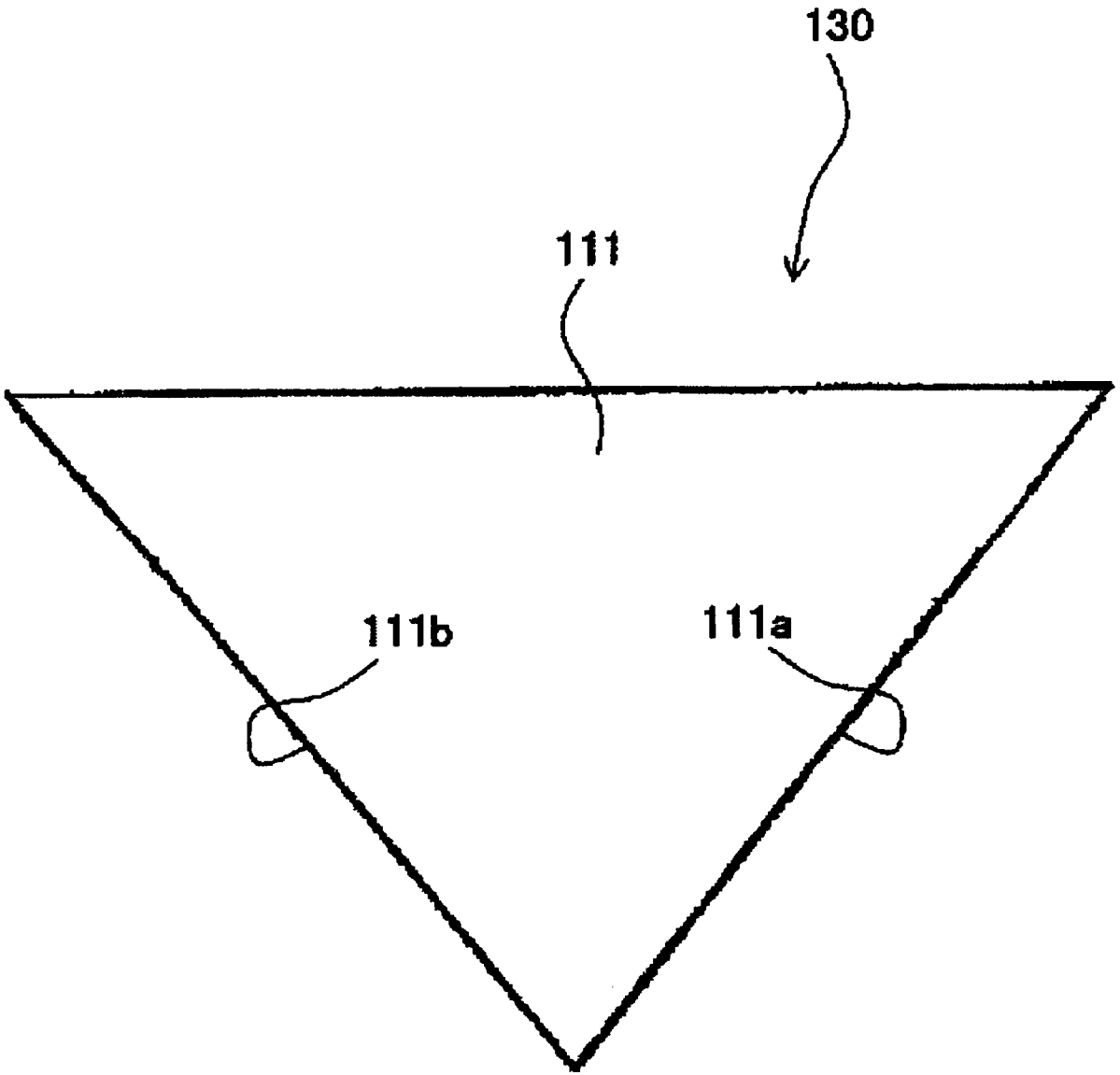
FIG. 12 is an enlarged plan view of a guiding member according to an illustrative aspect of the invention.

FIG. 12 is an enlarged plan view of the guiding member 130.

The guiding member 130 is the same as the guiding member 110 in Example 1 but the second guiding member 111 is omitted.

When the protrusion 330*c* is guided by the guiding member 130 when the process casing 59*a* is attached to the body frame 1, the protrusion 330*c* is finally registered at a position vertically below the rotating shaft 33*d*.

In this arrangement, the guiding member 130 may guide the protrusion 330*c* in a simpler configuration.

According to the first aspect of the invention, even when the photosensitive drum is detached from the main body of the image forming apparatus, the drum gear is registered to the predetermined rotational position by the guiding member which guides the rotating member when it is attached again, and hence a color drift can be suppressed.

According to the second aspect of the invention, for example, if the drum unit includes other members such as a developing roller with the photosensitive drum, the drum unit may be elongated in any direction orthogonal to the longitudinal direction of the photosensitive drum. However, in this configuration, since the direction of attachment or detachment of the drum unit is orthogonal to the longitudinal direction of the drum and hence the protrusion protrudes in the longitudinal direction of the photosensitive drum. Therefore, the length of the drum unit orthogonal to the longitudinal direction of the photosensitive drum does not affect the contact with the guiding member. In other words, it is not necessary to consider the length of the drum unit orthogonal to the longitudinal direction of the photosensitive drum to set the protruding amount of the protrusion.

According to the third aspect of the invention, since the protrusion is guided by a first guiding member to a position which enables contact against a second guiding member, the protrusion can contact against the second guiding member reliably, and the drum gear can be guided reliably to the predetermined rotational position.

According to the fourth aspect of the invention, since the protrusion is not caught by the first guiding member when the drum unit is removed, the drum unit can be taken out easily.

According to the fifth aspect of the invention, since the protrusion can be arranged outside the process casing easily by fixing a base member to an end of a rotating shaft projected to the outside of the process casing, it is not necessary to make the protrusion to protrude by a specifically large amount.

According to the sixth aspect of the invention, since the photosensitive drums pass a common area when the drum unit is attached, by arranging the guiding member in the common area, arrangement of a single guiding member can be sufficient and hence the cost for the member may be reduced.

According to the seventh aspect of the invention, even though the photosensitive drum is detached from the main body of the image forming apparatus, the drum gear is registered to a predetermined rotational position by the rotating member being guided when it is attached again. Therefore, the color drift can be suppressed.

According to the eighth aspect of the invention, for example, if the drum unit includes other members such as the developing roller with the photosensitive drum, the drum unit may be elongated in any direction orthogonal to the longitudinal direction of the photosensitive drum. However, in this configuration, since the direction of attachment or detachment of the drum unit is orthogonal to the longitudinal direction of the drum, the protrusion protrudes in the longitudinal direction of the photosensitive drum. Therefore, the length of the drum unit orthogonal to the longitudinal direction of the photosensitive drum does not affect the abutment with the guiding member. In other words, it is not necessary to consider the length of the drum unit orthogonal to the longitudinal direction of the photosensitive drum to set the protruding amount the protrusion.

According to the ninth aspect of the invention, since the protrusion may be arranged outside the process casing easily by coupling the base member to the end of the rotating shaft projected to the outside of the process casing, it is not necessary to make the protrusion to protrude by a specifically large amount.

What is claimed is:

1. An image forming apparatus of a tandem system comprising:

a main body;

a drum unit which is attachable to and detachable from the main body, the drum unit including:

a plurality of photosensitive drums;

a housing for rotatably supporting the plurality of photosensitive drums, for each photosensitive drum, a drum gear arranged at an end of the photosensitive drum for transmitting a drive force to the photosensitive drum, and for each photosensitive drum, a rotating member having a protrusion rotating with the drum gear, the protrusion being arranged at a position away from a center axis of the rotation of the photosensitive drum;

a transfer unit for transferring developer color images from respective photosensitive drums onto a medium; and a guide arranged in the main body for contacting each protrusion and guiding each rotating member during attachment of the drum unit to cause each drum gear to move to a respective predetermined position, wherein the drum unit is configured so that a direction of attachment to and detachment from the main body is orthogonal to a longitudinal direction of the photosensitive drums.

2. The image forming apparatus according to claim 1, wherein the protrusion is configured to protrude in the longitudinal direction of the photosensitive drums.

3. The image forming apparatus according to claim 1, wherein the guide comprises a first guiding member and a second guiding member, wherein the first guiding member is configured to contact each protrusion and guide each protrusion to a position that is configured to contact the second guiding member during attachment of the drum unit, and the second guiding member is configured to contact each protrusion and guide each rotating member to cause each drum gear to move to the respective predetermined position.

4. The image forming apparatus according to claim 3, wherein the first guiding member includes a first guiding surface for guiding each protrusion during detachment of the drum unit.

5. The image forming apparatus according to claim 4, further including a second guiding surface for guiding each protrusion during attachment of the drum unit, wherein the first guiding surface and the second guiding surface are different surfaces.

6. The image forming apparatus according to claim 3, wherein the first and second guiding members include triangular shaped faces.

7. The image forming apparatus according to claim 3, wherein the first guiding member includes a diamond shaped face and the second guiding member includes a rectangular shaped face.

8. The image forming apparatus according to claim 3, wherein the second guiding member includes two separate members each including a rectangular shaped face.

9. The image forming apparatus according to claim 1, wherein each photosensitive drum includes a rotating shaft rotatably supported by the housing, and each rotating member includes a base member coupled to an end of the rotating shaft and being configured so that each protrusion protrudes from the base member.

10. The image forming apparatus according to claim 1, wherein the plurality of photosensitive drums are configured to be arranged in a direction which matches a direction of attachment and detachment of the drum unit to the main body.

11. The image forming apparatus according to claim 1, wherein each protrusion is cylindrically shaped.

12. The image forming apparatus according to claim 1, wherein the guide includes a member with a triangular shaped face.

13. The image forming apparatus according to claim 1, wherein the guide includes a member having a diamond shaped face.

14. A drum unit being attachable to and detachable from a main body of an image forming apparatus comprising:

a plurality of photosensitive drums;

a housing for rotatably supporting the plurality of photosensitive drums, for each photosensitive drum, a drum gear arranged at an end of the photosensitive drum for transmitting a drive force to the photosensitive drum, and for each photosensitive drum, a rotating member having a protrusion rotating with the drum gear, the protrusion being arranged at a position away from a center axis of rotation of the photosensitive drum, the rotating member configured to contact a member in the main body of the image forming apparatus, wherein the drum unit is configured to be attached to and detached from the main body of the image forming apparatus in a direction orthogonal to a longitudinal direction of the photosensitive drums.

15. The drum unit according to claim 14, wherein each protrusion protrudes in the longitudinal direction of the photosensitive drums.

16. The drum unit according to claim 14, wherein each photosensitive drum includes a rotating shaft rotatably supported by the housing, and each rotating member includes a base member coupled to an end of the rotating shaft, and each protrusion is configured to protrude from the base member.

17. The drum unit according to claim 14, wherein each protrusion is cylindrically shaped.

* * * * *